US011808494B2

(12) United States Patent
Zou et al.

(10) Patent No.: US 11,808,494 B2
(45) Date of Patent: Nov. 7, 2023

(54) HEAT PUMP WATER HEATER SYSTEMS AND METHODS FOR LOW AMBIENT TEMPERATURE CONDITIONS

(71) Applicant: Rheem Manufacturing Company, Atlanta, GA (US)

(72) Inventors: Yang Zou, Frisco, TX (US); Sivakumar Gopalnarayanan, Plano, TX (US)

(73) Assignee: Rheem Manufacturing Company, Atlanta, GA (US)

( * ) Notice: Subject to any disclaimer, the term of this patent is extended or adjusted under 35 U.S.C. 154(b) by 38 days.

(21) Appl. No.: 17/510,642

(22) Filed: Oct. 26, 2021

(65) Prior Publication Data

US 2023/0129242 A1 Apr. 27, 2023

(51) Int. Cl.

| | |
|---|---|
| ***F25B 30/02*** | (2006.01) |
| ***F25B 39/00*** | (2006.01) |
| ***F25B 49/02*** | (2006.01) |

(52) U.S. Cl.

CPC ..... *F25B 30/02* (2013.01); *F25B 39/00* (2013.01); *F25B 49/02* (2013.01); *F25B 2400/075* (2013.01); *F25B 2600/2515* (2013.01); *F25B 2700/2106* (2013.01)

(58) Field of Classification Search

CPC ..... F25B 30/02; F25B 39/00; F25B 49/02; F25B 2400/075; F25B 2600/2515; F25B 2700/2106; F24D 3/18; F24F 5/0096; F24H 4/02

See application file for complete search history.

(56) References Cited

U.S. PATENT DOCUMENTS

| | | | | |
|---|---|---|---|---|
| 2008/0041072 | A1* | 2/2008 | Seefeldt | F25B 13/00 62/196.2 |
| 2017/0349451 | A1* | 12/2017 | Lockwood | B01D 3/007 |
| 2019/0186801 | A1* | 6/2019 | Kopko | F25B 23/006 |
| 2021/0348811 | A1* | 11/2021 | Shanmugam | F25B 47/02 |
| 2022/0214055 | A1* | 7/2022 | Iwasaki | F25B 49/02 |

FOREIGN PATENT DOCUMENTS

| | | |
|---|---|---|
| EP | 0072543 A2 | 2/1983 |
| EP | 3351871 A1 | 7/2013 |

OTHER PUBLICATIONS

PCT, "International Search Report & Written Opinion" Application No. PCT/US2022/044882, dated Dec. 19, 2022, 13 pages.

* cited by examiner

*Primary Examiner* — Len Tran
*Assistant Examiner* — Kamran Tavakoldavani
(74) *Attorney, Agent, or Firm* — Eversheds Sutherland (US) LLP

(57) ABSTRACT

The disclosed technology includes devices, systems, and methods for heat pump systems configured to operate in low ambient temperatures. The disclosed technology can include a heat pump water heater system having an evaporator, a first compressor configured to compress refrigerant to a first pressure, and a second compressor configured to compress the refrigerant to a second pressure. The second pressure can be greater than the first pressure. The heat pump water heater system can include a preheater configured to receive the refrigerant at the first pressure and heat water and a condenser configured to receive the refrigerant at the second pressure and heat water. The water can be passed through the preheater before being passed through the condenser.

20 Claims, 14 Drawing Sheets

FIG. 1 - PRIOR ART

HEAT PUMP WATER HEATER SYSTEMS AND METHODS FOR LOW AMBIENT TEMPERATURE CONDITIONS

FIELD OF TECHNOLOGY

The disclosed technology relates generally to heat pump systems and, more particularly, to heat pump systems configured to operate in low ambient temperatures.

BACKGROUND

Heat pump water heater systems are becoming increasingly more common as many industries move away from pollution-emitting combustion hot water heater systems and toward more efficient and environmentally friendly systems. Rather than create heat energy directly through combustion or other energy sources, heat pump water heaters are generally designed to transfer heat from a heat source (e.g., ambient air, geothermal heat sources, etc.) to water stored in a tank using a vapor-compression cycle. Heat pump water heaters can be used to efficiently heat water for end uses such as household hot water use, commercial hot water use, radiator space heating, floor space heating, and other similar uses.

Heat pump systems typically include a compressor, a condenser, an expansion valve, and an evaporator. As refrigerant is circulated by the compressor through the condenser, expansion valve, and evaporator, the refrigerant is transitioned between vapor and liquid phases causing heat to be absorbed by the refrigerant at the evaporator and released by the refrigerant at the condenser. The condenser can be a heat exchanger configured to transfer the heat from the refrigerant to the water. By utilizing a vapor-compression cycle, heat pumps are able to heat water efficiently without creating harmful combustion gasses or other pollutant byproducts.

Unfortunately, heat pump water heaters have been limited in their application due to many heat pump water heater systems being unable to effectively heat water in low ambient temperatures. Thus, heat pump water heaters have typically not been effectively implemented in regions having cooler climates. This is because the heat pump must work harder to heat the water to the threshold temperature as the ambient temperature decreases because the efficiency and capacity of the heat pump deceases with decreasing ambient temperatures.

One method of sufficiently heating the water in cool climates includes arranging two heat pumps in a cascading configuration. As illustrated in FIG. 1, existing cascade heat pump water heater systems include two or more compressors 102A, 102B and two or more expansion valves 106A, 106B. The first compressor 102A can circulate a first refrigerant through an intermediate heat exchanger 130, a first expansion valve 106A, and an evaporator 108. The intermediate heat exchanger 130 can facilitate heat transfer between the first refrigerant and a second refrigerant circulated by the second compressor 102B to heat the second refrigerant. Because the second refrigerant is heated by the first refrigerant, the second refrigerant can be heated to a higher temperature to sufficiently heat water in cooler climates. Because cascading heat pump systems must operate both compressors in order to heat water, cascading heat pump systems tend to become more expensive to manufacture and operate for similar heating capacities compared to single stage heat pump systems. This is particularly true in regions where the climate is warm for some time during the year. As the ambient temperature rises above a low threshold temperature, there is no longer a need to operate both compressors and the cascading heat pump water heater arrangement becomes unnecessary and inefficient.

What is needed, therefore, is a heat pump water heater system that can sufficiently heat water in low ambient temperature conditions while also increasing the overall efficiency of the heat pump water heater in both cool and warm ambient temperatures.

SUMMARY

These and other problems are addressed by the technology disclosed herein. The disclosed technology relates generally to heat pump systems and, more particularly, to heat pump systems capable of operating in low ambient temperatures. The disclosed technology can include a heat pump water heater system having an evaporator configured to facilitate heat exchange between ambient air and a refrigerant, a first compressor configured to compress the refrigerant to a first pressure, and a second compressor configured to compress the refrigerant to a second pressure. The second pressure can be greater than the first pressure. The heat pump water heater system can include a preheater configured to receive the refrigerant at the first pressure from the first compressor and facilitate heat exchange between the refrigerant at the first pressure and water, and a condenser configured to receive the refrigerant at the second pressure from the second compressor and facilitate heat exchange between the refrigerant at the second pressure and the water. The heat pump water heater system can be configured to pass the water through the preheater before passing the water through the condenser.

The heat pump water heater system can further include a control valve that can be configured to control a flow of the refrigerant to the second compressor, an ambient air temperature sensor that can be configured to detect a temperature of ambient air, and a controller. The controller can be configured to receive ambient air temperature data from the ambient air temperature sensor and determine, based at least in part on the ambient air temperature data, whether the temperature of the ambient air is less than or equal to a low ambient temperature threshold. In response to determining that the temperature of the ambient air is less than or equal to the low ambient temperature threshold, the controller can output a first control signal to open the control valve to permit the refrigerant to flow to the second compressor. The controller can also output a second control signal to cause the second compressor to compress the refrigerant to the second pressure.

The second compressor can be configured to receive the refrigerant at the first pressure from the first compressor and the control valve can be positioned in a fluid flow path between the first compressor and the second compressor.

The evaporator can be a first evaporator. The heat pump water heater system can further include a second evaporator. The first evaporator can be configured to receive the refrigerant from the condenser and the second evaporator can be configured to receive the refrigerant from the preheater. The control valve can be positioned in a fluid flow path downstream of the first evaporator and the second evaporator and upstream of the first compressor and the second compressor.

The heat pump water heater system can further include a subcooler. The subcooler can be configured to receive the refrigerant from the condenser and facilitate heat transfer between the water and the refrigerant received from the condenser.

The heat pump water heater system can further include a water flow control valve. The water flow control valve can be configured to control a flow of water to the preheater, the subcooler, and the condenser.

In response to determining that the temperature of the ambient air is less than or equal to the low ambient temperature threshold, the controller can be further configured to output a control signal to the water flow control valve to cause the water to flow through the subcooler.

The evaporator can be an interlaced microchannel heat exchanger configured to facilitate heat transfer between the refrigerant at the first pressure and the ambient air, and the refrigerant at the second pressure and the ambient air. The interlaced microchannel heat exchanger can be configured to fluidly separate the refrigerant at the first pressure, the refrigerant at the second pressure, and the ambient air.

The refrigerant at the first pressure and the refrigerant at the second pressure can be two different types of refrigerant. For example, the refrigerant at the first pressure can be R1234yf refrigerant and the refrigerant at the second pressure can be $CO_2$.

The disclosed technology can include a heat pump water heater system having an evaporator configured to facilitate heat exchange between ambient air and a refrigerant, and a compressor. The compressor can include a first outlet and a second outlet. The compressor can be configured to (i) compress the refrigerant to a first pressure and output the refrigerant at the first pressure from the first outlet and (ii) compress the refrigerant to a second pressure and output the refrigerant at the second pressure from the second outlet. The second pressure can be greater than the first pressure.

The heat pump water heater system can further include a preheater configured to receive the refrigerant at the first pressure from the first outlet and facilitate heat exchange between the refrigerant at the first pressure and water, and a condenser configured to receive the refrigerant at the second pressure from the second outlet and facilitate heat exchange between the refrigerant at the second pressure and the water. The water can be configured to pass through the preheater before passing through the condenser.

The heat pump water heater system can further include an ambient air temperature sensor configured to detect a temperature of ambient air and a controller. The controller can be configured to receive ambient air temperature data from the ambient air temperature sensor and determine, based at least in part on the ambient air temperature data, whether the temperature of the ambient air is less than or equal to a low ambient temperature threshold. In response to determining that the temperature of the ambient air is less than or equal to the low ambient temperature threshold, the controller can be configured to output a control signal to cause the compressor to open the second outlet to cause the refrigerant at the second pressure to pass through the condenser.

The evaporator can be a first evaporator and the heat pump water heater system can further include a second evaporator. The first evaporator can be configured to receive the refrigerant from the condenser and the second evaporator can be configured to receive the refrigerant from the preheater.

The heat pump water heater system can further include a subcooler. The subcooler can be configured to receive the refrigerant from the condenser and facilitate heat transfer between the water and the refrigerant received from the condenser.

The heat pump water heater system can further include a water flow control valve. The water flow control valve can be configured to control a flow of water to the preheater, the subcooler, and the condenser.

In response to determining that the temperature of the ambient air is less than or equal to the low ambient temperature threshold, the controller can be configured to output a control signal to the water flow control valve to cause the water to flow through the subcooler.

The evaporator can be an interlaced microchannel heat exchanger configured to facilitate heat transfer between the refrigerant at the first pressure and the ambient air, and the refrigerant at the second pressure and the ambient air. The interlaced microchannel heat exchanger can be configured to fluidly separate the refrigerant at the first pressure, the refrigerant at the second pressure, and the ambient air.

Additional features, functionalities, and applications of the disclosed technology are discussed herein in more detail.

BRIEF DESCRIPTION OF THE DRAWINGS

The accompanying drawings, which are incorporated in and constitute a part of this specification, illustrate various aspects of the presently disclosed subject matter and serve to explain the principles of the presently disclosed subject matter. The drawings are not intended to limit the scope of the presently disclosed subject matter in any manner.

DETAILED DESCRIPTION

Figure 1:
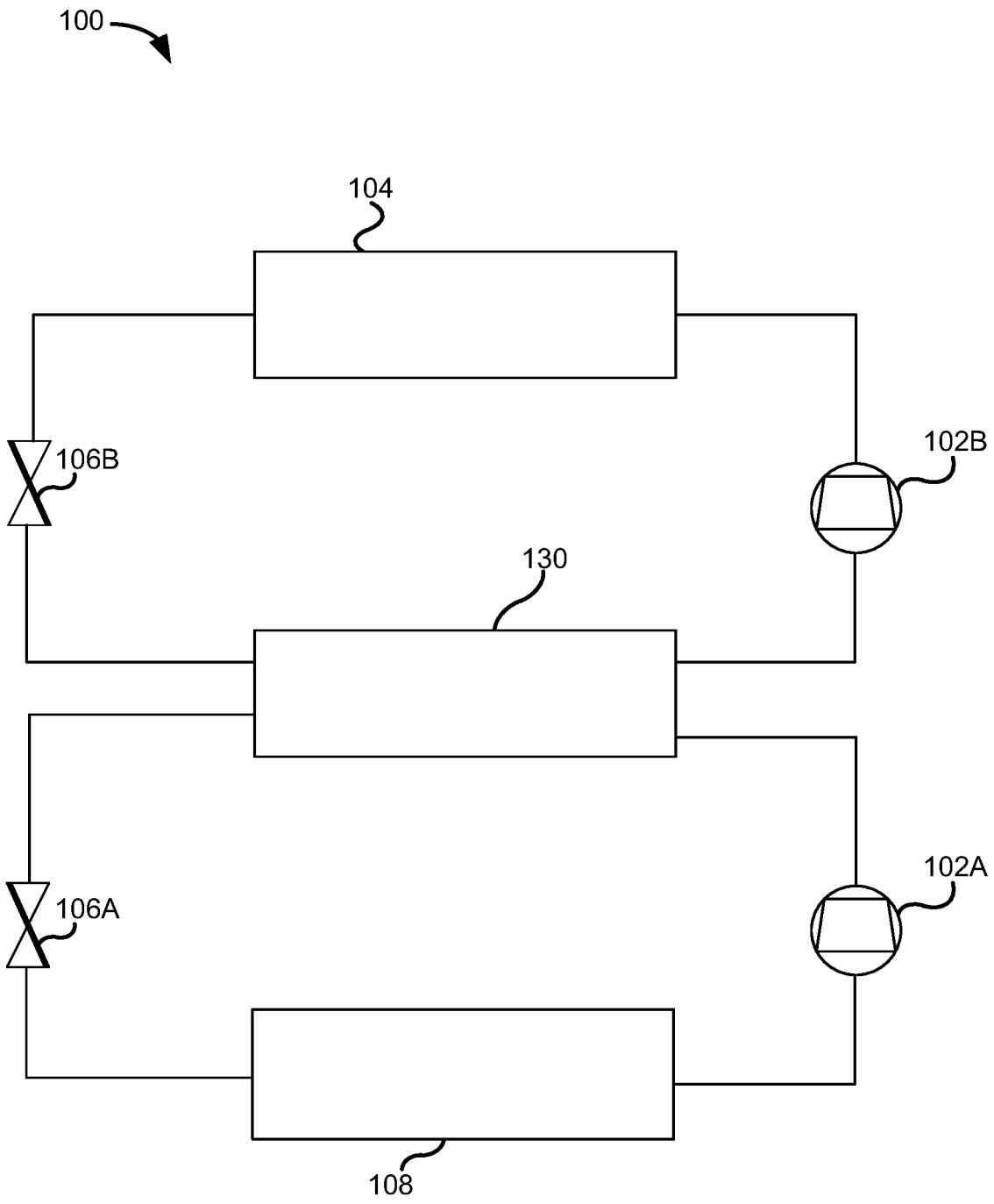
FIG. 1 illustrates an existing heat pump water heating system.

The disclosed technology can include heat pump water heater systems that are configured to operate in both cool and warm climates. For example, the disclosed technology can include heat pump water heater systems that can sufficiently heat water in warm climates as well as in climates where the ambient temperature can remain below freezing temperatures for extended periods of time. As a non-limiting example, the heat pump water heater systems described herein can be configured to operate in ambient temperatures as low as −10° F. The heat pump water heater system can include one or more compressors that can circulate a first refrigerant at a first pressure and a second refrigerant at a second pressure. The second pressure can be greater than the first pressure. The heat pump water heater can include a preheater and the refrigerant at the first pressure can be circulated through the preheater to heat water from an inlet temperature to an intermediate temperature. The water can subsequently be passed through a condenser and further heated to a greater temperature by the refrigerant at the second pressure. By having two heat exchangers (a preheater and a condenser) that can add heat to the water, the HPWH can efficiently heat water to higher temperatures and be operated in cooler climates. Furthermore, the HPWH can be further configured to circulate only the refrigerant at the first pressure or only the refrigerant at the second pressure depending on the temperature of the ambient air or the temperature of the supply water. Further configurations and advantages of the disclosed technology will become apparent throughout this disclosure.

Although various aspects of the disclosed technology are explained in detail herein, it is to be understood that other aspects of the disclosed technology are contemplated. Accordingly, it is not intended that the disclosed technology is limited in its scope to the details of construction and arrangement of components expressly set forth in the following description or illustrated in the drawings. The disclosed technology can be implemented and practiced or carried out in various ways. In particular, the presently disclosed subject matter is described in the context of being systems and methods for use with a heat pump water heating system. The present disclosure, however, is not so limited, and can be applicable in other contexts. The present disclosure can, for example, include devices and systems for use with air conditioning systems, refrigeration systems, pool water heat systems, and other similar systems. Furthermore, although described in the context of being a water heater, the disclosed technology can be configured to heat fluids other than water. For example, the disclosed technology can be configured to heat air, oil, glycol, refrigerants, silicones, or other fluids. Furthermore, the disclosed technology can be implemented in various commercial and industrial fluid heating systems used to heat fluids other than water. Accordingly, when the present disclosure is described in the context of a heat pump water heater system, it will be understood that other implementations can take the place of those referred to.

Although described herein as being a heat pump water heater configured to be deployed in low ambient temperature conditions, the disclosed technology can also be implemented in air conditioning systems configured to operate in high or low ambient temperature conditions. For example, the disclosed technology is described herein as having a water flow path to heat water to a high temperature using one or more heat exchangers. If the disclosed technology is deployed in an air heating context, the water flow path described herein can be and air flow path and the system can function much the same as the water heating system (e.g., the system will heat the air to a sufficient temperature even if the ambient temperature is low). If the disclosed technology is deployed in an air conditioning context (i.e., space cooling), the water flow path described herein can be an air flow path and the system can be configured to operate a first compressor in moderate ambient temperature conditions and both the first and a second compressor in high ambient temperature conditions. Thus, although described in the context of being a water heating system, one of skill in the art will appreciate that the disclosed technology can also be applicable to air conditioning systems without departing from the scope of this disclosure.

It should also be noted that, as used in the specification and the appended claims, the singular forms "a," "an," and "the" include plural references unless the context clearly dictates otherwise. References to a composition containing "a" constituent is intended to include other constituents in addition to the one named.

Also, in describing the disclosed technology, terminology will be resorted to for the sake of clarity. It is intended that each term contemplates its broadest meaning as understood by those skilled in the art and includes all technical equivalents which operate in a similar manner to accomplish a similar purpose.

Ranges may be expressed herein as from "about" or "approximately" or "substantially" one particular value and/or to "about" or "approximately" or "substantially" another particular value. When such a range is expressed, the disclosed technology can include from the one particular value and/or to the other particular value. Further, ranges described as being between a first value and a second value are inclusive of the first and second values. Likewise, ranges described as being from a first value and to a second value are inclusive of the first and second values.

Herein, the use of terms such as "having," "has," "including," or "includes" are open-ended and are intended to have the same meaning as terms such as "comprising" or "comprises" and not preclude the presence of other structure, material, or acts. Similarly, though the use of terms such as "can" or "may" are intended to be open-ended and to reflect that structure, material, or acts are not necessary, the failure to use such terms is not intended to reflect that structure, material, or acts are essential. To the extent that structure, material, or acts are presently considered to be essential, they are identified as such.

It is also to be understood that the mention of one or more method steps does not preclude the presence of additional method steps or intervening method steps between those steps expressly identified. Moreover, although the term "step" can be used herein to connote different aspects of methods employed, the term should not be interpreted as implying any particular order among or between various steps herein disclosed unless and except when the order of individual steps is explicitly required. Further, the disclosed technology does not necessarily require all steps included in the methods and processes described herein. That is, the disclosed technology includes methods that omit one or more steps expressly discussed with respect to the methods described herein.

The components described hereinafter as making up various elements of the disclosed technology are intended to be illustrative and not restrictive. Many suitable components that would perform the same or similar functions as the components described herein are intended to be embraced within the scope of the disclosed technology. Such other components not described herein can include, but are not limited to, similar components that are developed after development of the presently disclosed subject matter.

Figure 2:
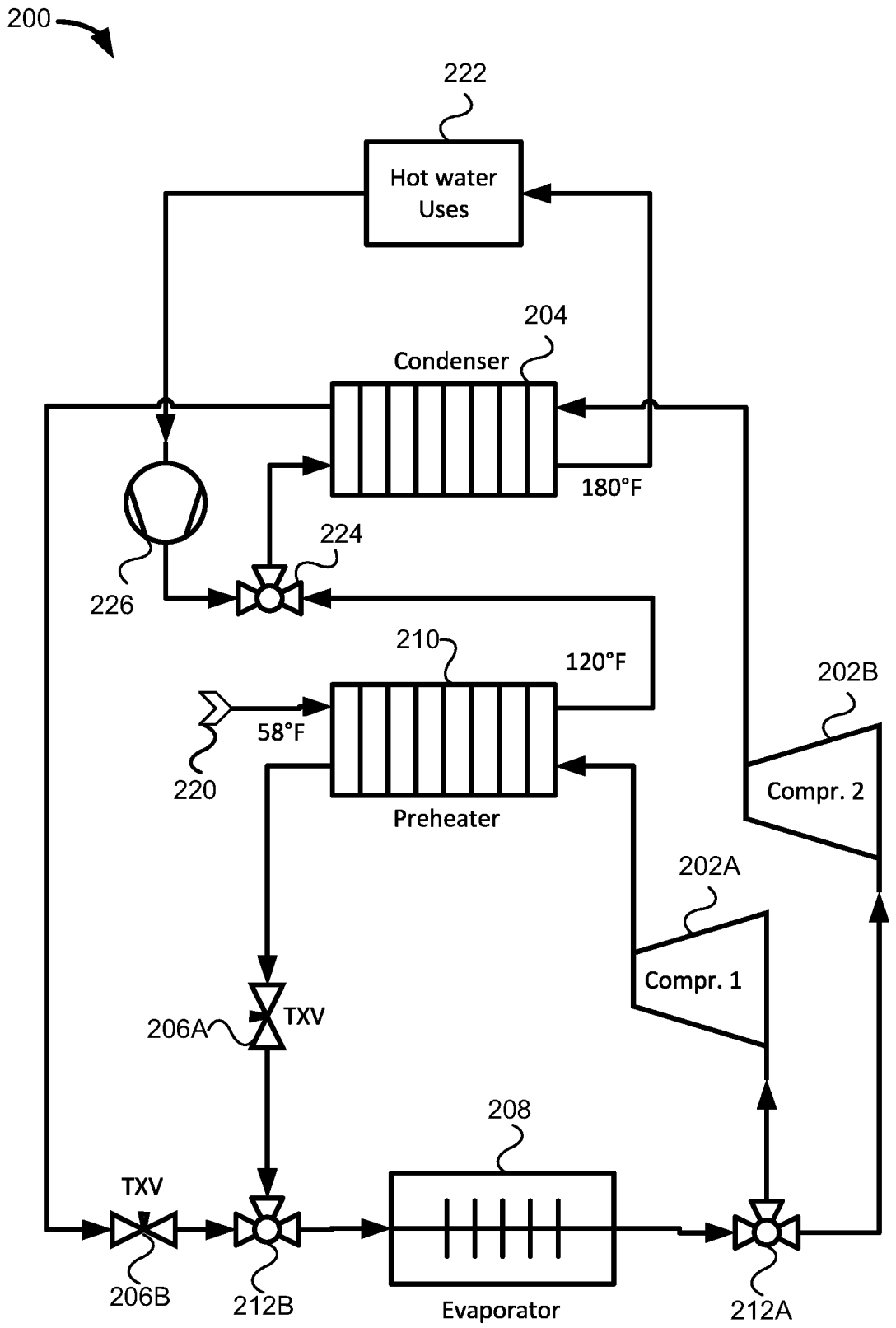
FIG. 2 illustrates a schematic diagram of an example heat pump water heater system having two compressors, in accordance with the disclosed technology.

Referring now to the drawings, in which like numerals represent like elements, the present disclosure is herein described. FIG. 2 illustrates a heat pump water heater (HPWH) 200 that is configured to heat water even in low ambient temperature conditions. The HPWH 200 can include a first compressor 202A, a second compressor 202B, an evaporator 208, a first expansion valve 206A, a second expansion valve 206B, and a preheater 210. The first compressor can be configured to compress refrigerant in the HPWH 200 to a first pressure and circulate the refrigerant through the preheater 210, the first expansion valve (first TXV) 206A, and the evaporator 208. The second compressor 202B can be configured to compress the refrigerant in the HPWH 200 to a second pressure that is higher than the first pressure and circulate the refrigerant through the condenser 204, the second expansion valve (second TXV) 206B, and the evaporator 208. As will be appreciated by one of skill in the art, as the refrigerant is circulated by either the first compressor 202A or the second compressor 202B, the refrigerant can receive heat from the ambient air at the evaporator 208 and transfer the heat to the water at either the preheater 210 or the condenser 204. By having the first and second compressors 202A, 202B that can each compress the refrigerant to different pressures, the HPWH 200 can effectively heat water to a target temperature in both cooler and warmer climates. Furthermore, by having the first and second compressors 202A, 202B, the HPWH 200 can be configured to operate more efficiently than cascade HPWHs at least because each compressor (202A and 202B) can be operated as needed to heat the water (i.e., simultaneously, separately and independently) rather than continuously operating simultaneously.

To control a flow of the refrigerant through the HPWH 200, the HPWH can include one or more refrigerant control valves 212A, 212B. The refrigerant control valves 212A, 212B can be configured to direct a flow of refrigerant through the first compressor 202A and the preheater 210 and/or through the second compressor 202B and the condenser 204. For example, the refrigerant control valve 212A can be positioned in a fluid flow path downstream of the evaporator 208 and upstream of the first and second compressor 202A, 202B, and the refrigerant control valve 212B can be positioned in a fluid flow path downstream of the condenser 204 and the preheater 210 and upstream of the evaporator 208. The refrigerant control valves 212A, 212B can each be configured to selectively permit or prevent refrigerant from flowing through the first compressor 202A and the second compressor 202B. For example, in low load conditions (e.g., when the ambient temperature is greater than a low ambient temperature threshold or the water temperature is less than a high water temperature threshold), the refrigerant control valves 212A, 212B can be actuated such that refrigerant flows only through the first compressor 202A and the preheater 210 and not through the second compressor 202B and the condenser 204. In high load conditions (e.g., when the ambient temperature is less than or equal to a low ambient temperature threshold or the water temperature is greater than or equal to a high water temperature threshold), the refrigerant control valves 212A, 212B can be actuated such that refrigerant flows through the first compressor 202A, the preheater 210, the second compressor 202B, and the condenser 204. In intermediate load conditions (e.g., when a higher water temperature is required and the ambient temperature is greater than a low ambient temperature threshold or the water temperature is less than a high water temperature threshold), the refrigerant control valves 212A, 212B can be actuated such that refrigerant flows only through the second compressor 202B and the condenser 204 and not through the first compressor 202A and the preheater 210. As will be appreciated, the HPWH 200 can conserve energy in low load conditions compared to existing systems at least because only the first compressor 202A is operated and the refrigerant is compressed to a lower pressure than when both the first and second compressors 202A, 202B are operated concurrently.

The refrigerant control valves 212A, 212B can be any type of valve suitable for the application. For example, the refrigerant control valves 212A, 212B can be a ball valve, a plug valve, a butterfly valve, a gate valve, a globe valve, a needle valve, a coaxial valve, an angle seat valve, a three-way valve, or any other type of valve that would be suitable for the particular application. Furthermore, the refrigerant control valves 212A, 212B can be configured to be controlled by any suitable method, including manually controlled, electronically controlled, pneumatically controlled, and/or hydraulically controlled. Further still, the refrigerant control valves 212A, 212B can be the same or different types of control valves. For example, refrigerant control valve 212A can be a ball valve while refrigerant control valve 212B can be a needle valve. As will be described in greater detail herein, the refrigerant control valves 212A, 212B can be configured to receive control signals from a controller (e.g., controller 1140 described in relation to FIG. 11) and actuate a position (open, closed, partially opened, partially closed, etc.) of the refrigerant control valves 212A, 212B based on the received control signal.

The HPWH 200 can be configured to receive water from a water source 220. For example, the water source 220 can be a city water supply, a well, a stream, a spring, or any other suitable water source for the particular application. The water from the water source 220 can be at a first, normally cooler, temperature prior to entering the preheater 210. As a non-limiting example, the water entering the HPWH 200 from the water source 220 can be approximately 58° F. As the water passes through the preheater 210, the water can be heated to an intermediate temperature. For example, and not limitation, the water can be heated to approximately 120° F. as it passes through the preheater 210. As the water passes from the preheater 210 and through the condenser 204, the water can be further heated to a higher temperature threshold. For example, and not limitation, the water can be heated to approximately 180° F. as it passes through the condenser 204. As will be appreciated by one of skill in the art, the various example temperatures are offered merely for illustrative purposes and should not be construed as limiting as the HPWH 200 can be configured to heat the water to any suitable temperature for the application.

As the water is heated, the water can be used for various hot water uses 222 including, but not limited to, supplying heated water to a faucet, dishwashing, clothes washing, radiator space heating, floor space heating, and other suitable hot water uses 222. Furthermore, as illustrated in FIG.

2 and depending on the application, the water can be circulated by a water pump 226 back through at least the condenser 204 to reheat the water. For example, where the water is used for space heating, the HPWH 200 can circulate water back through the condenser 204 to reheat the water for heating the space. As will be appreciated, the water may not need to be heated to the same temperature for space heating as would be necessary for other water uses. In some applications, for example, water at a temperature of approximately 80° F. to 100° F. would be sufficient for space heating, while water at a temperature of greater than 120° F. would be necessary for other hot water uses 222. In this case, the water used for space heating can be heated by just the preheater 210 while the water used for other hot water uses 222 can be heated by both the preheater 210 and the condenser 204. Although not illustrated in FIG. 2, the HPWH 200 can, for example, include a water line that can route water downstream of the preheater 210 but upstream of the condenser 204 to be used for space heating. The water used for space heating can be circulated back through the preheater 210 to reheat the water for space heating. Furthermore, the space heating configurations just described can be applied to any of the HPWHs illustrated in FIGS. 3-10 and described herein. Thus, it is to be understood that the hot water uses 222 described in relation to FIGS. 3-10 can include any of the hot water uses 222, including space heating, described in relation to FIG. 2.

To help control the flow of the water, the HPWH 200 can include a water control valve 224. The water control valve 224 can be positioned in a fluid flow path downstream of the preheater 210 and the condenser 204. The water control valve 224 can be any type of valve suitable for the application. For example, the water control valve 224 can be a ball valve, a plug valve, a butterfly valve, a gate valve, a globe valve, a needle valve, a coaxial valve, an angle seat valve, a three-way valve, or any other type of valve that would be suitable for the particular application. Furthermore, the water control valve 224 can be configured to be controlled by any suitable method, including manually controlled, electronically controlled, pneumatically controlled, and/or hydraulically controlled.

The compressors 202A, 202B can be any type of compressor. For example, the compressors 202A, 202B can each be a positive displacement compressor, a reciprocating compressor, a rotary screw compressor, a rotary vane compressor, a rolling piston compressor, a scroll compressor, an inverter compressor, a diaphragm compressor, a dynamic compressor, an axial compressor, or any other form of compressor that can be integrated into the HWPH 200 for the particular application. The compressors 202A, 202B can be a fixed speed or a variable speed compressor depending on the application. Furthermore, the compressors 202A, 202B can both be the same type of compressor or each be a different type of compressor depending on the application.

The condenser 204, the evaporator 208, and the preheater 210 can each be or include any type of heat exchanger coil configured to facilitate heat transfer between fluids. The fluid, for example, can be refrigerant, air, water, glycol, dielectric fluids, or any other type of fluid suitable for the particular application. As a non-limiting example, the evaporator 208 can be a heat exchanger configured to facilitate heat exchanger between air and refrigerant while the condenser 204 and the preheater 210 can both be configured to facilitate heat exchanger between the refrigerant and water. The condenser 204, the evaporator 208, and the preheater 210 can be or include, for example, a shell and tube heat exchanger, a double pipe heat exchanger, a plate heat exchanger, a tube-and-fin heat exchanger, a microchannel heat exchanger, or any other suitable heat exchanger for the application.

FIGS. 3-6 illustrate example variations of heat pump water heaters having two compressors (e.g., compressors 202A and 202B). As will be described in greater detail herein, each variation illustrated in FIGS. 3-6 and described herein can help to increase the efficiency of the HPWH 200. Furthermore, each of the variations illustrated and described herein can be combined to alter the performance of the HPWH 200 depending on the particular application. As a non-limiting example, the configuration of FIG. 3 can be combined with the configurations of FIGS. 4-6 depending on the application. Thus, one of skill in the art will appreciate that each of the configurations described in relation to FIGS. 2-6 are not exclusive and can be combined as would be suitable for a particular application. Furthermore, unless stated otherwise, the components described in relation to FIG. 2 can be the same or similar components to those described in relation to FIGS. 3-6.

Figure 3:
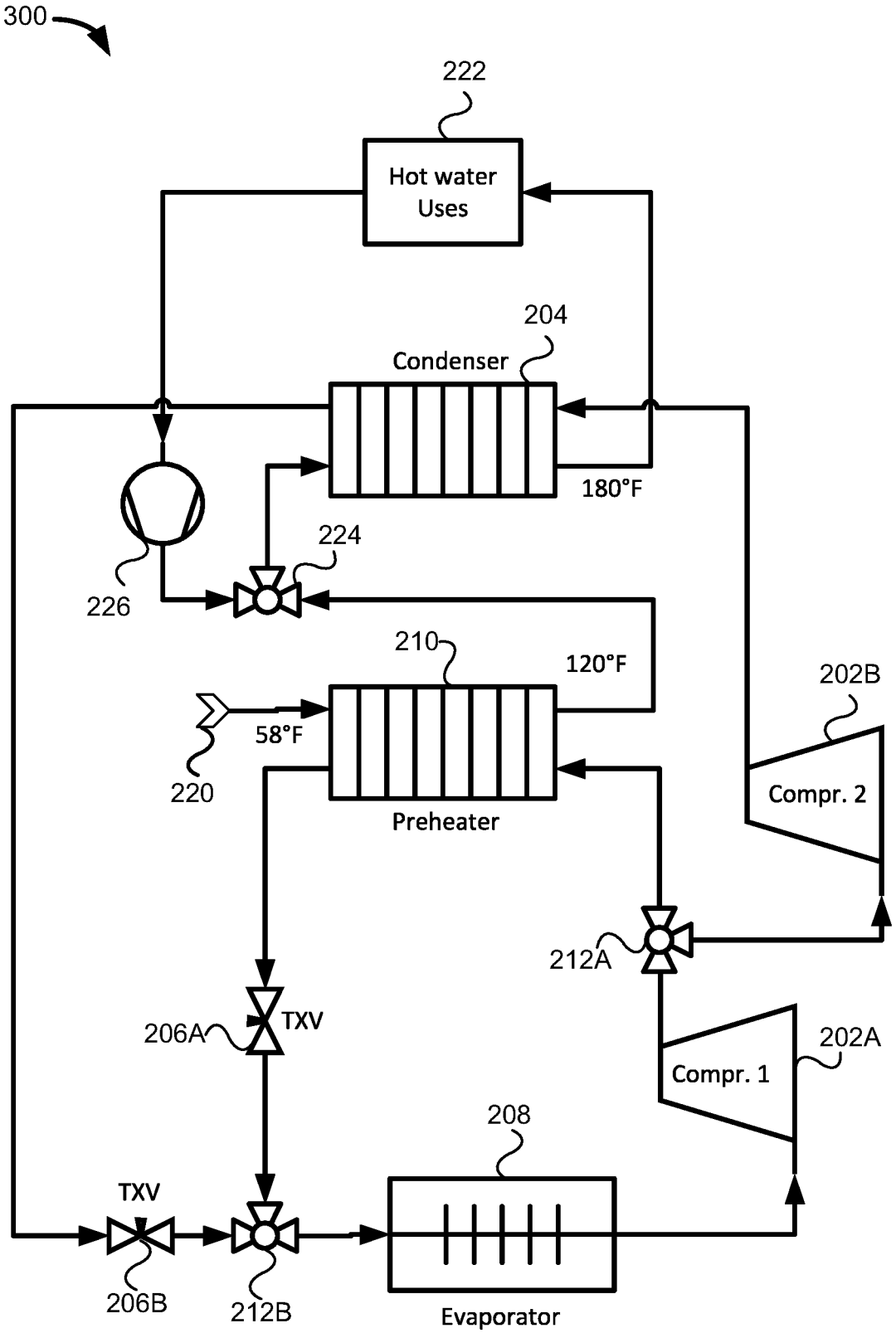
FIG. 3 illustrates a schematic diagram of an example heat pump water heater system having two compressors, in accordance with the disclosed technology.

FIG. 3 illustrates a HPWH 300 having all of the same components described in relation to FIG. 2. The refrigerant control valve 212A of the HPWH 300, however, can be positioned in a fluid flow path downstream of the first compressor 202A such that refrigerant from the first compressor 202A can be directed to either the preheater 210 or to the second compressor 202B depending on the position of the refrigerant control valve 212A. For example, in low load conditions (e.g., when the ambient temperature is greater than a low ambient temperature threshold or the water temperature is less than a high water temperature threshold), the refrigerant control valve 212A can be actuated such that refrigerant flows only through the first compressor 202A and the preheater 210 and not through the second compressor 202B and the condenser 204. In high load conditions (e.g., when the ambient temperature is less than or equal to a low ambient temperature threshold or the water temperature is greater than or equal to a high water temperature threshold), the refrigerant control valve 212A can be actuated such that refrigerant flows first through the first compressor 202A and then through the second compressor 202B before being passed through the condenser 204. In this way, the HPWH 300 can be configured to reduce the pressure lift for the second compressor 202B, which can increase the overall efficiency of the HPWH 300.

Figure 4:
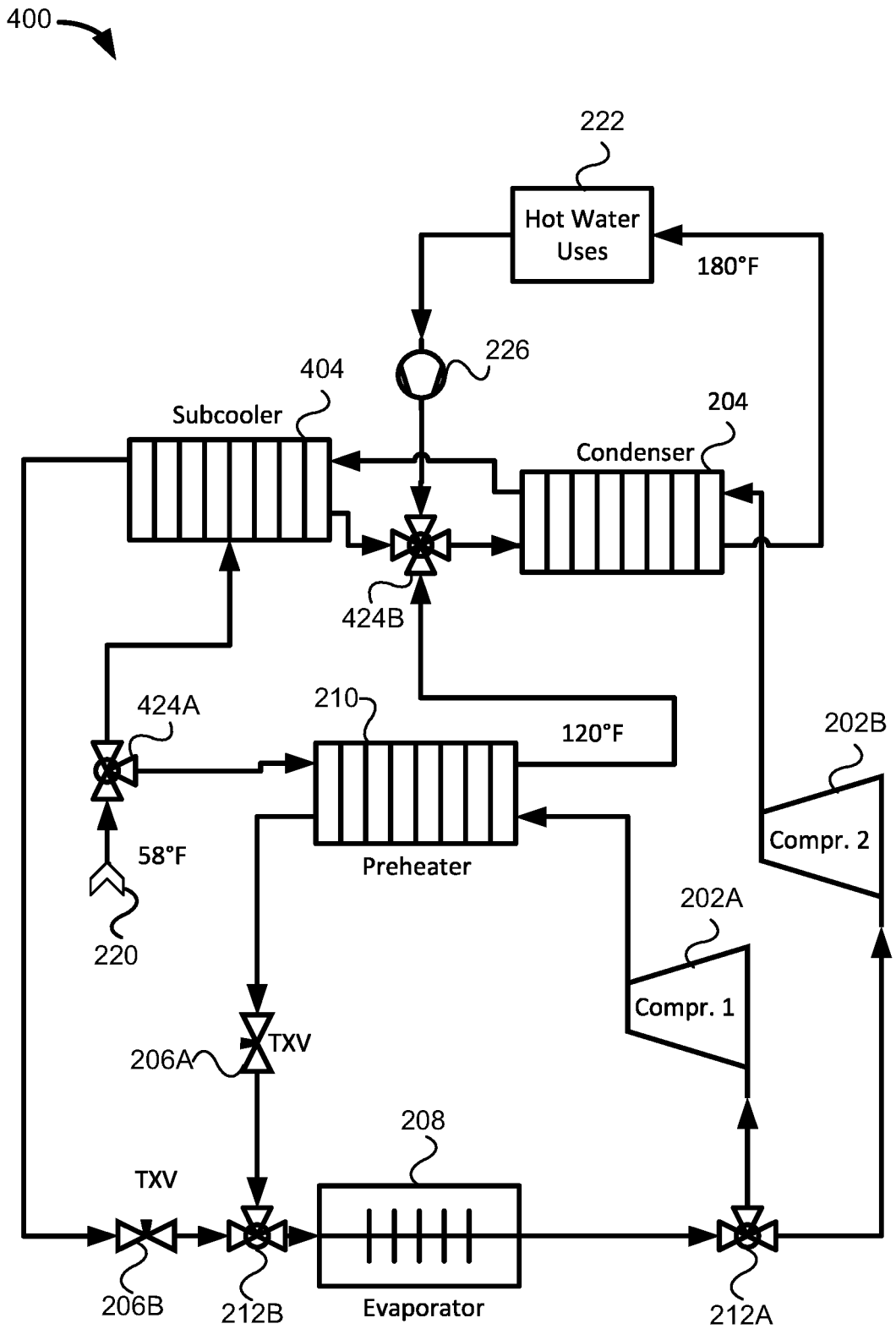
FIG. 4 illustrates a schematic diagram of an example heat pump water heater system having two compressors and two condensers, in accordance with the disclosed technology.

FIG. 4 illustrates a HPWH 400 having all of the same components of described in relation to FIG. 2. The HPWH 400, however, can further include a subcooler 404 that can be configured to preheat the water before the water is passed to the condenser 204 and to subcool the refrigerant directed to the subcooler 404 from the condenser 204. As will be appreciated by one of skill in the art, by subcooling the refrigerant, the overall efficiency of the HPWH 400 can be increased. Furthermore, because the subcooler 404 can preheat the water similar to the preheater 210, the HPWH 400 can be configured to preheat the water with either the preheater 210 or the subcooler 404.

The refrigerant control valves 212A, 212B can be configured to control a flow of the refrigerant similar to the configuration described in relation to FIG. 2 depending on whether the load demand is high or low. For example, in low load conditions (e.g., when the ambient temperature is greater than a low ambient temperature threshold or the water temperature is less than a high water temperature threshold), the refrigerant control valves 212A, 212B can be actuated such that refrigerant flows only through the first compressor 202A and the preheater 210 and not through the second compressor 202B, the condenser 204, or the subcooler 404. In high load conditions (e.g., when the ambient temperature is less than or equal to a low ambient temperature threshold or the water temperature is greater than or equal to a high water temperature threshold), the refrigerant control valves 212A, 212B can be actuated such that refrigerant flows through the first compressor 202A, the preheater 210, the second compressor 202B, the condenser 204, and the subcooler 404. In intermediate load conditions (e.g., when a higher water temperature is required and the ambient temperature is greater than a low ambient temperature threshold or the water temperature is less than a high water temperature threshold), the refrigerant control valves 212A, 212B can be actuated such that refrigerant flows only through the second compressor 202B, the condenser 204, and the subcooler 404 and not through the first compressor 202A and the preheater 210. As will be appreciated, the HPWH 400 can conserve energy in low load conditions compared to existing systems because only the first compressor 202A is operated and the refrigerant is compressed to a lower pressure than when both the first and second compressors 202A, 202B are operated concurrently. Furthermore, the HPWH 400 can conserve energy even in high load or intermediate load conditions because the subcooler 404 can help to increase the overall efficiency of the HPWH 400 by further cooling the refrigerant and by preheating the water.

The HPWH 400 can further include a first water control valve 424A and a second water control valve 424B. The first water control valve 424A can be positioned in a fluid flow path upstream of the preheater 210 and the subcooler 404 such that the first water control valve 424A can control a flow of the water from the water source 220 to the preheater 210 and the subcooler 404. The second water control valve 424B can be positioned in a fluid flow path downstream of the preheater 210 and the subcooler 404 and upstream of the condenser 204. In this way, the second water control valve 424B can control a flow of the water from the preheater 210 and the subcooler 404 to the condenser 204.

As will be appreciated, the first and second water control valves 424A, 424B can be configured to control a flow of the water through either the preheater 210, the subcooler 404, or both depending on the load conditions. For example, in low load conditions (e.g., when the ambient temperature is greater than a low ambient temperature threshold or the water temperature is less than a high water temperature threshold), the first and second water control valves 424A, 424B can be actuated such that water flows through the preheater 210 and not the subcooler 404. In high load conditions (e.g., when the ambient temperature is less than or equal to a low ambient temperature threshold or the water temperature is greater than or equal to a high water temperature threshold), the first and second water control valves 424A, 424B can be actuated such that water flows either through preheater 210, or the subcooler 404, or both. In intermediate load conditions (e.g., when a higher water temperature is required and the ambient temperature is greater than a low ambient temperature threshold or the water temperature is less than a high water temperature threshold), the first and second water control valves 424A, 424B can be actuated such that water flows through the subcooler 404 and not through the preheater 210. In this way, the HPWH 400 can be configured to heat the water using the most efficient method of preheating (i.e., either by the preheater 210, the subcooler 404, or both). Furthermore, as will be appreciated, if the HPWH 400 is configured for space heating, the water can be circulated back through the subcooler 404 to facilitate heating of the water for the space heating.

Figure 5:
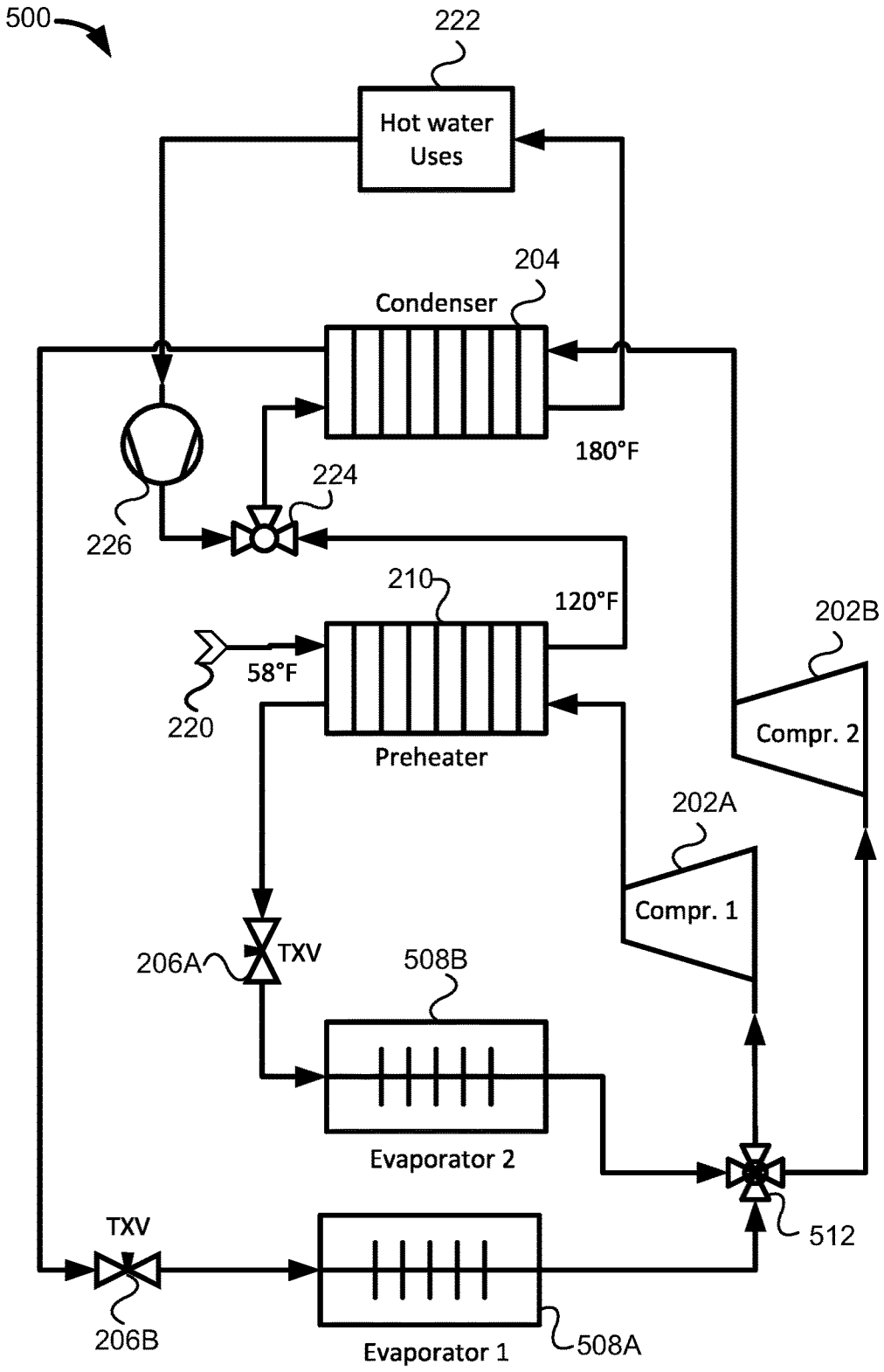
FIG. 5 illustrates a schematic diagram of an example heat pump water heater system having two compressors and two evaporators, in accordance with the disclosed technology.

FIG. 5 illustrates a HPWH 500 having all of the same components of described in relation to FIG. 2. The HPWH 500, however, can further include a first evaporator 508A and a second evaporator 508B. By including a first evaporator 508A and a second evaporator 508B, the HPWH 500 can operate more efficiently when the HPWH 500 is operating both the first and second compressors 202A, 202B due to a greater amount of surface area being available for heat transfer. The first evaporator 508A can be positioned in a fluid flow path downstream of the condenser 204 and the second evaporator 508B can be positioned in a fluid flow path downstream of the preheater 210. Thus, refrigerant circulated through the condenser 204 will pass only through the first evaporator 508A and refrigerant circulated through the preheater 210 will pass only through the second evaporator 508B.

The HPWH 500 can further include a refrigerant control valve 512 that can be configured to control a flow of the refrigerant from the first and second evaporators 508A, 508B. The refrigerant control valve 512 can be a four-way valve that can be positioned in a fluid flow path downstream of the first and second evaporators 508A, 508B and upstream of the first and second compressors 202A, 202B. In low load conditions (e.g., when the ambient temperature is greater than a low ambient temperature threshold or the water temperature is less than a high water temperature threshold), the refrigerant control valve 512 can be actuated such that refrigerant flows only through the first compressor 202A, the preheater 210, and the second evaporator 508B and not through the second compressor 202B, the condenser 204, or the first evaporator 508A. In high load conditions (e.g., when the ambient temperature is less than or equal to a low ambient temperature threshold or the water temperature is greater than or equal to a high water temperature threshold), the refrigerant control valve 512 can be actuated such that refrigerant flows through the first compressor 202A, the preheater 210, the second evaporator 508B, the second compressor 202B, the condenser 204, and the first evaporator 508A. In intermediate load conditions (e.g., when a higher water temperature is required and the ambient temperature is greater than a low ambient temperature threshold or the water temperature is less than a high water temperature threshold), the refrigerant control valve 512 can be actuated such that refrigerant flows only through the second compressor 202B, the condenser 204, and the first evaporator 508A and not through the first compressor 202A, the preheater 210, and the second evaporator 508B. As will be appreciated, the HPWH 500 can conserve energy in high load conditions compared to existing systems because the first and second evaporator 508A, 508B provide a greater amount of heat transfer surface to increase the overall efficiency of the HPWH 500.

Figure 6:
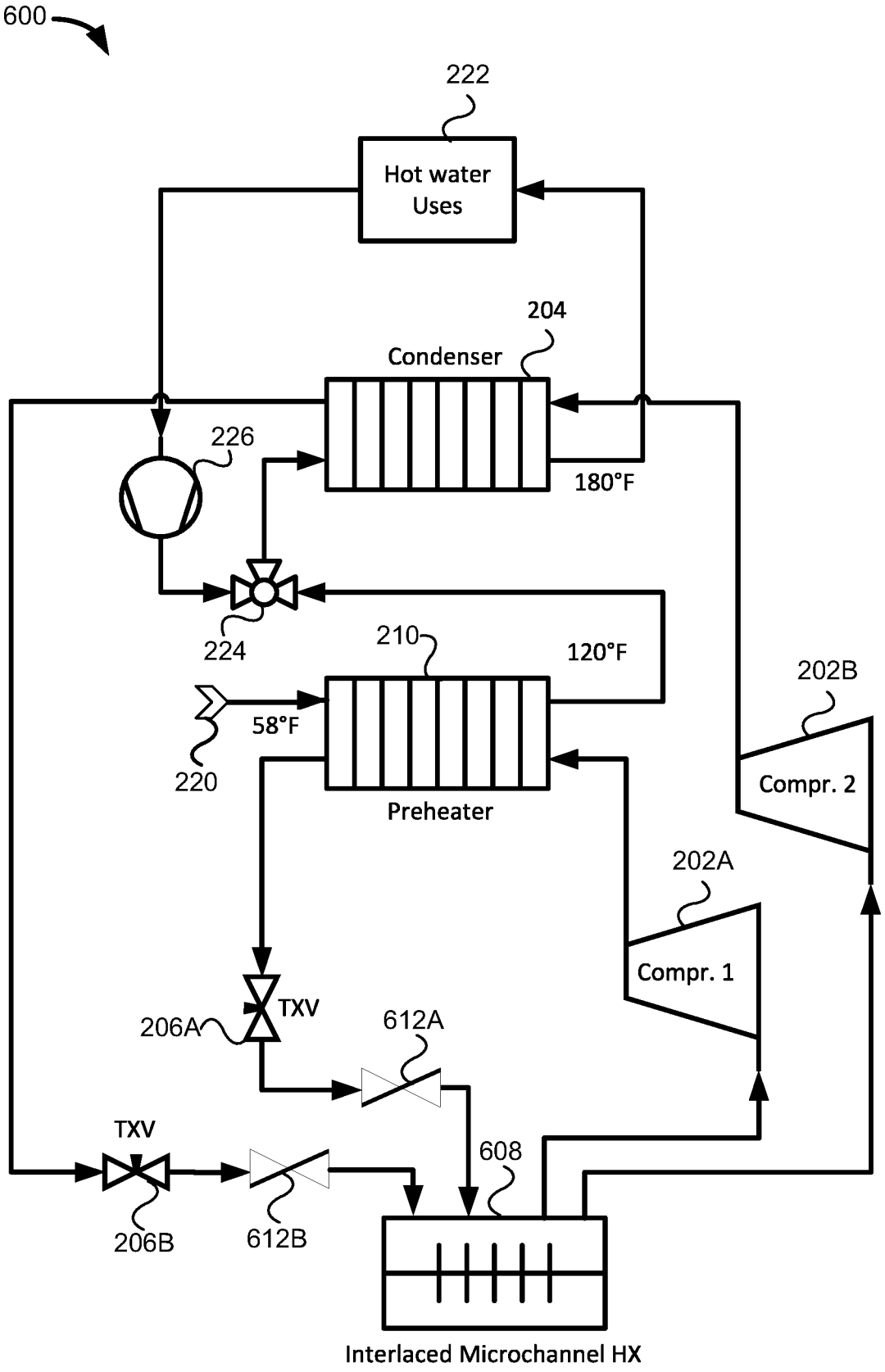
FIG. 6 illustrates a schematic diagram of an example heat pump water heater system having two compressors and an interlaced microchannel heat exchanger, in accordance with the disclosed technology.

FIG. 6 illustrates a HPWH 600 having all of the same components of described in relation to FIG. 2. The HPWH 600, however, can further include an interlaced microchannel heat exchanger 608. The interlaced microchannel heat exchanger 608 can be in place of the evaporator 208 and be configured to receive refrigerant from the preheater 210 and the condenser 204. The interlaced microchannel heat exchanger 608 can be configured to fluidly separate the refrigerant circulated through the first compressor 202A from refrigerant circulated through the second compressor 202B such that the HPWH 600 comprises two separate refrigerant loops. Because the HPWH 600 can have two separate refrigerant loops, the HPWH 600 can be configured to comprise two types of refrigerants. As a non-limiting example, R-32, R-290, R-410A, R-454B, R-454C, R-457A, R-468C, R-744, or other similar refrigerants can be circulated by the first compressor 202A and ($CO_2$), R-134a, R-1234yf, R-513A, R-515B, and R-516A or other similar refrigerants can be circulated by the second compressor 202B. Alternatively, or in addition, the refrigerants can be used interchangeably between the first compressor 202A and the second compressor 202B depending on the particular application. In this way, the HPWH 600 can include a refrigerant that is better able to handle the higher pressure of the second compressor 202B as compared to the refrigerant used in the first compressor 202A. Furthermore, the HPWH 600 can reduce the amount of flammable refrigerant (e.g. R1234yf) used in the HPWH 600 because at least the refrigerant circulated by the second compressor 202B can be $CO_2$. For example, the refrigerant circulated through the preheater 210 can be R1234yf refrigerant and the refrigerant circulated through the condenser 204 can be $CO_2$.

The interlaced microchannel heat exchanger 608 can include a first refrigerant circuit configured to permit the refrigerant from the condenser 204 to pass through and a second refrigerant circuit configured to permit the refrigerant from the preheater 210 to pass through. The interlaced microchannel heat exchanger 608 can include a shared heat transfer area which can help to reduce the overall size of the HPWH 600. The first refrigerant circuit and the second refrigerant circuit can be individually controlled with built-in control valves integrated into the interlaced microchannel heat exchanger 608. Alternatively, the first refrigerant circuit and the second refrigerant circuit can be individually controlled by refrigerant control valves (e.g., refrigerant control valves 612A, 612B) or simply by controlling the first and second compressors 202A, 202B.

Figure 7A:
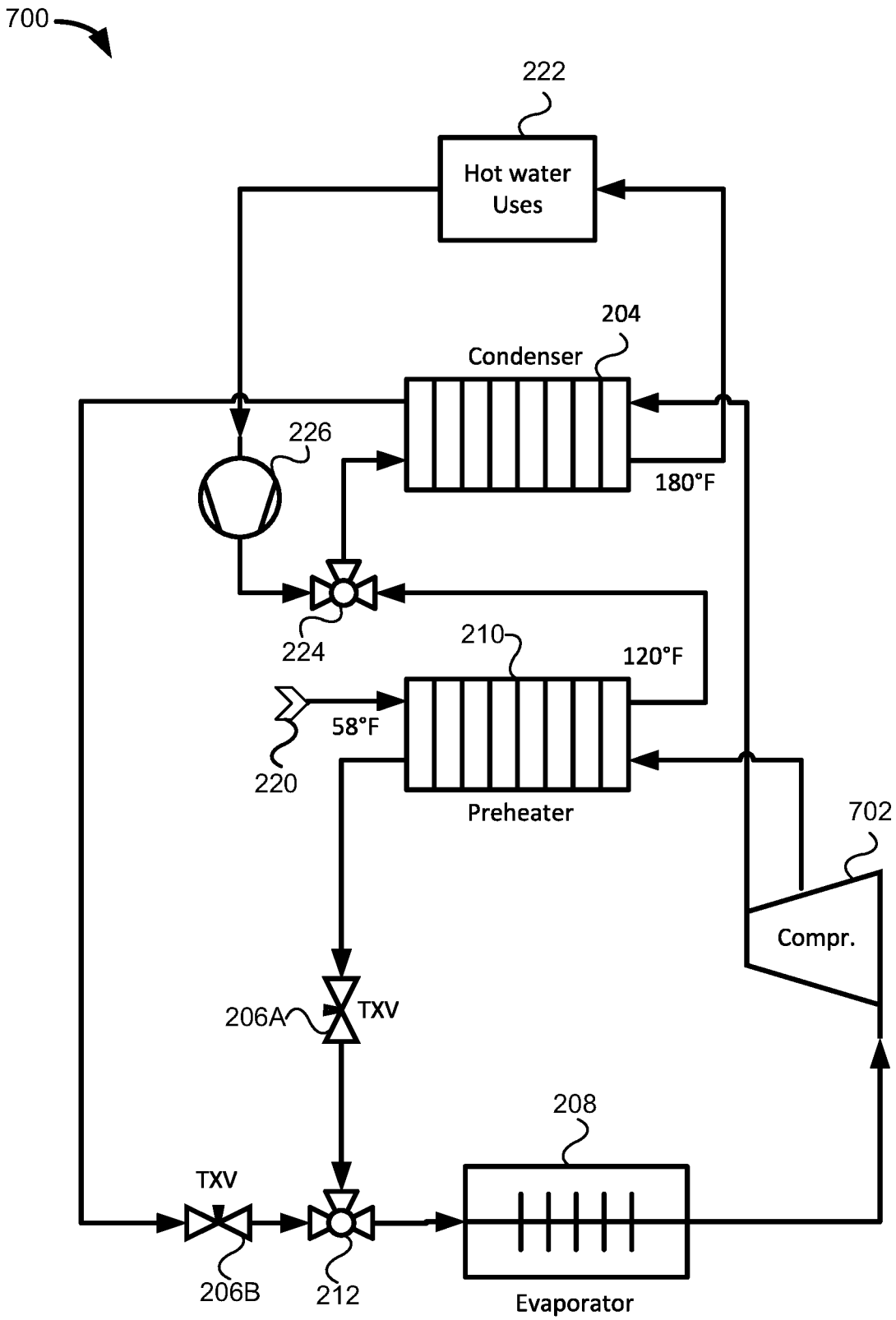
FIG. 7A illustrates a schematic diagram of an example heat pump water heater system having a single compressor with two outlets, in accordance with the disclosed technology.

FIG. 7A illustrates a HPWH 700 having a single compressor 702 having two outlets. The HPWH 700 can include all of the same components described in relation to FIG. 2 except with respect to the single compressor 702. The single compressor 702 can be in place of the first compressor 202A and the second compressor 202B which can enable the HPWH 700 to comprise a more compact and efficient design than the HPWH 200.

The single compressor 702 can include a first outlet that can be in a fluid flow path upstream of the preheater 210 and a second outlet that can be in a fluid flow path upstream of the condenser 204. The single compressor 702 can be configured to output refrigerant at a first pressure from the first outlet (a low pressure refrigerant outlet) and refrigerant at a second pressure from the second outlet (a high pressure refrigerant outlet). The second pressure can be a greater pressure than the first pressure. In this way, the single compressor 702 can perform the same or similar function as the first compressor 202A and the second compressor 202B.

Figure 7B:
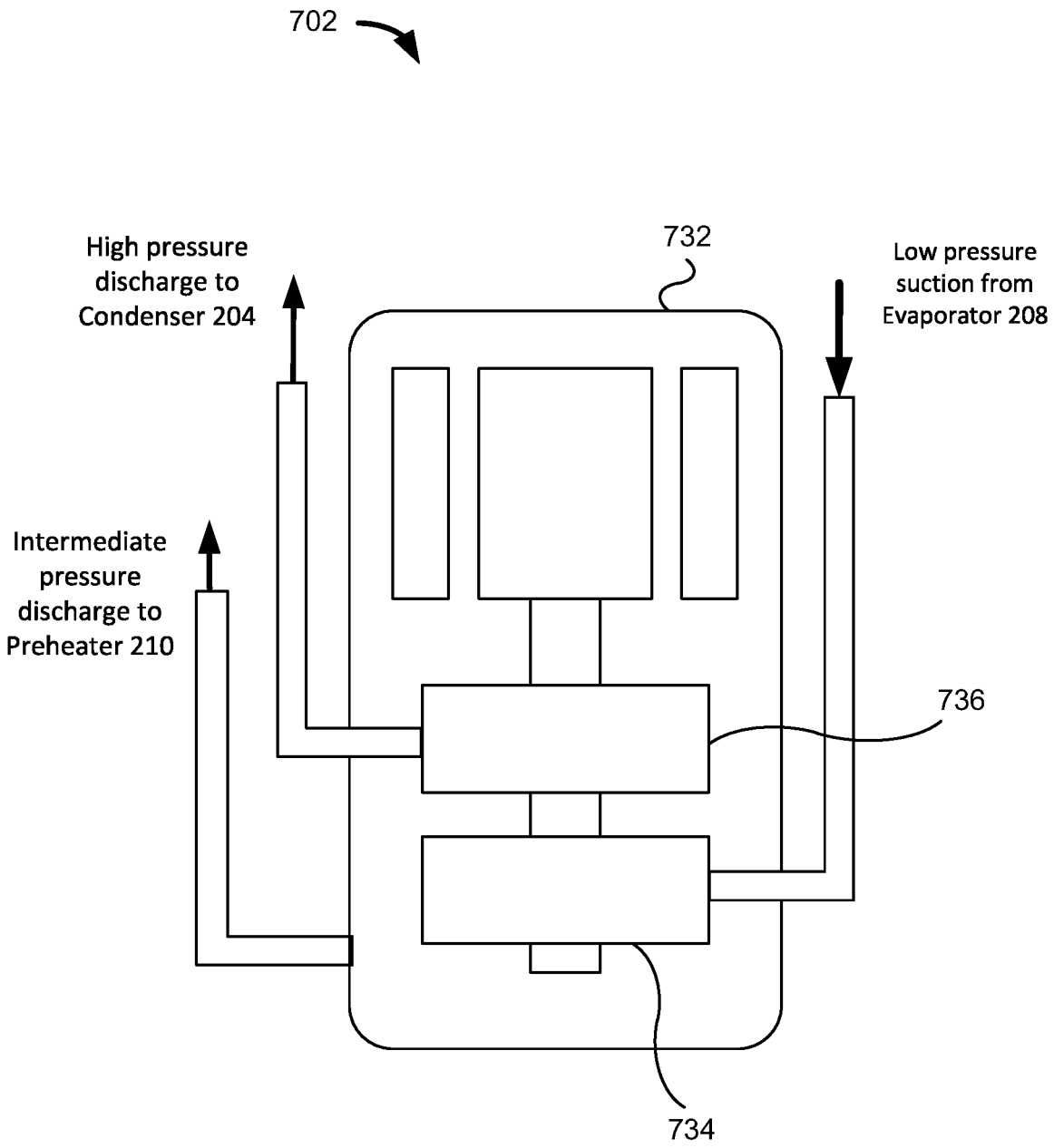
FIG. 7B illustrates a schematic diagram of a single compressor having two outlets, in accordance with the disclosed technology.

As illustrated in FIG. 7B, the single compressor 702 can be a compressor having multiple compression chambers such that refrigerant can be compressed to different pressures in each chamber. For example, the single compressor 702 can be a rolling piston compressor have a first compression chamber 734 that can be configured to compress the refrigerant in the first compression chamber 734 to the first pressure and a second compression chamber 736 that can be configured to compress the refrigerant in the second compression chamber 736 to the second pressure. At least some of the refrigerant in the first compression chamber 734 can be passed to the second compression chamber 736 to further compress the refrigerant to a higher pressure. As a non-limiting example, the single compressor 702 can be configured to release some of the refrigerant compressed to an intermediate pressure in the first compression chamber 734 to the shell 732 of the single compressor 702. The intermediate-pressure refrigerant can then be released from the shell 732 through an outlet to the preheater 210. The single compressor 702 can be further configured to admit some of the intermediate-pressure refrigerant to the second compression chamber 736 to further compress the refrigerant to a high pressure and then pass the high-pressure refrigerant through an outlet of the second compression chamber 736 to the condenser 204. The single compressor 702 can be configured to selectively permit just the intermediate pressure refrigerant from the first compression chamber 734 to exit the single compressor 702 or only the high-pressure refrigerant from the second compression chamber 736 to exit the single compressor 702. As another non-limiting example, the single compressor 702 can be a multi-circuit compressor having multiple circuits fluidly separated from each other with each circuit being configured to compress the refrigerant to a different pressure. As will be appreciated by one of skill in the art, various configurations and methods can be used to compress the refrigerant by the single compressor 702 to at least two different pressures to be passed through the preheater 210 and the condenser 204. The single compressor 702 can also be a rotary vane compressor, a reciprocating compressor, a scroll compressor, or any other suitable type of compressor for the application.

Figure 8:
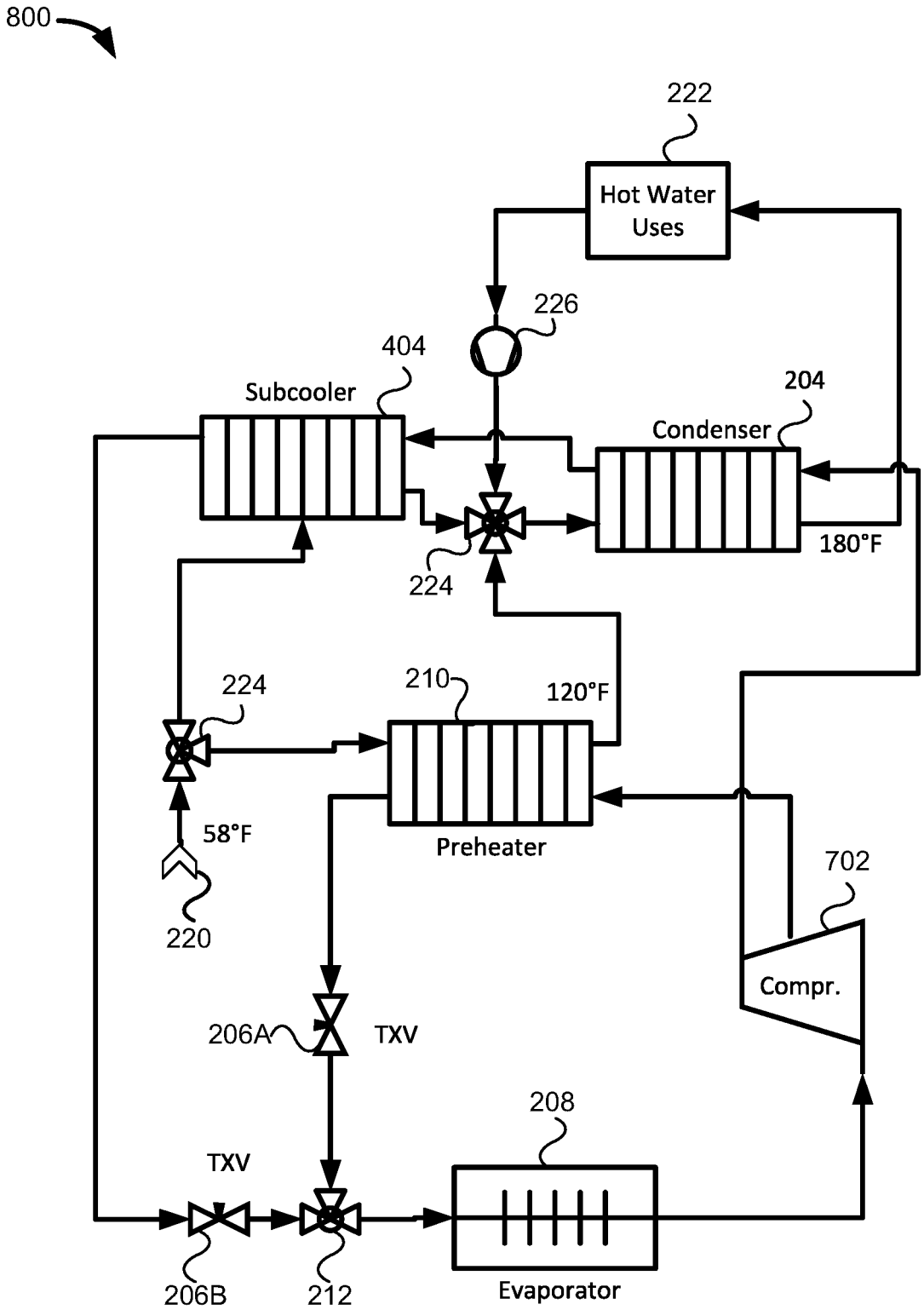
FIG. 8 illustrates a schematic diagram of an example heat pump water heater system having two condensers and a single compressor with two outlets, in accordance with the disclosed technology.
Figure 9:
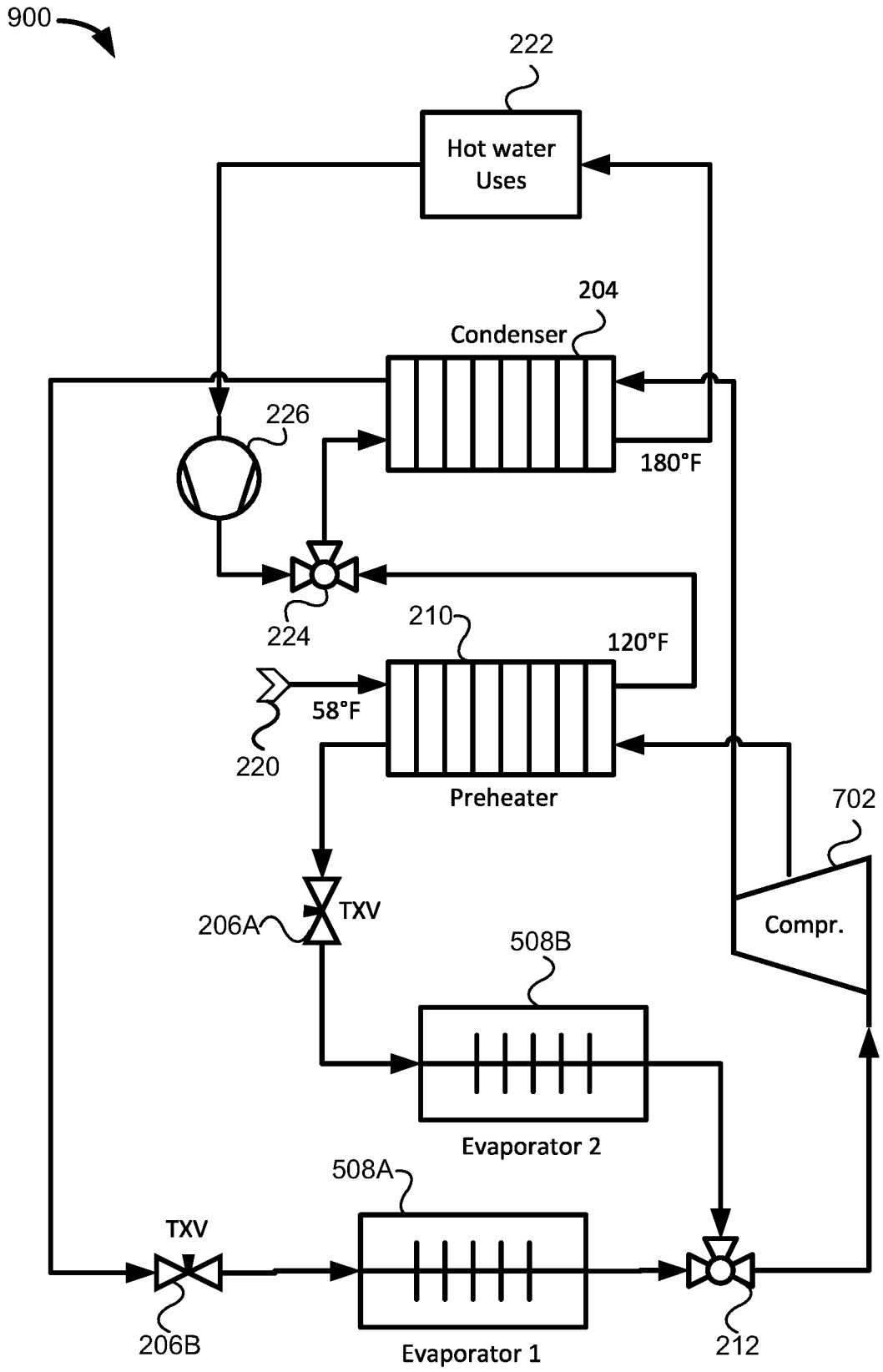
FIG. 9 illustrates a schematic diagram of an example heat pump water heater system having two evaporators and a single compressor with two outlets, in accordance with the disclosed technology.
Figure 10:
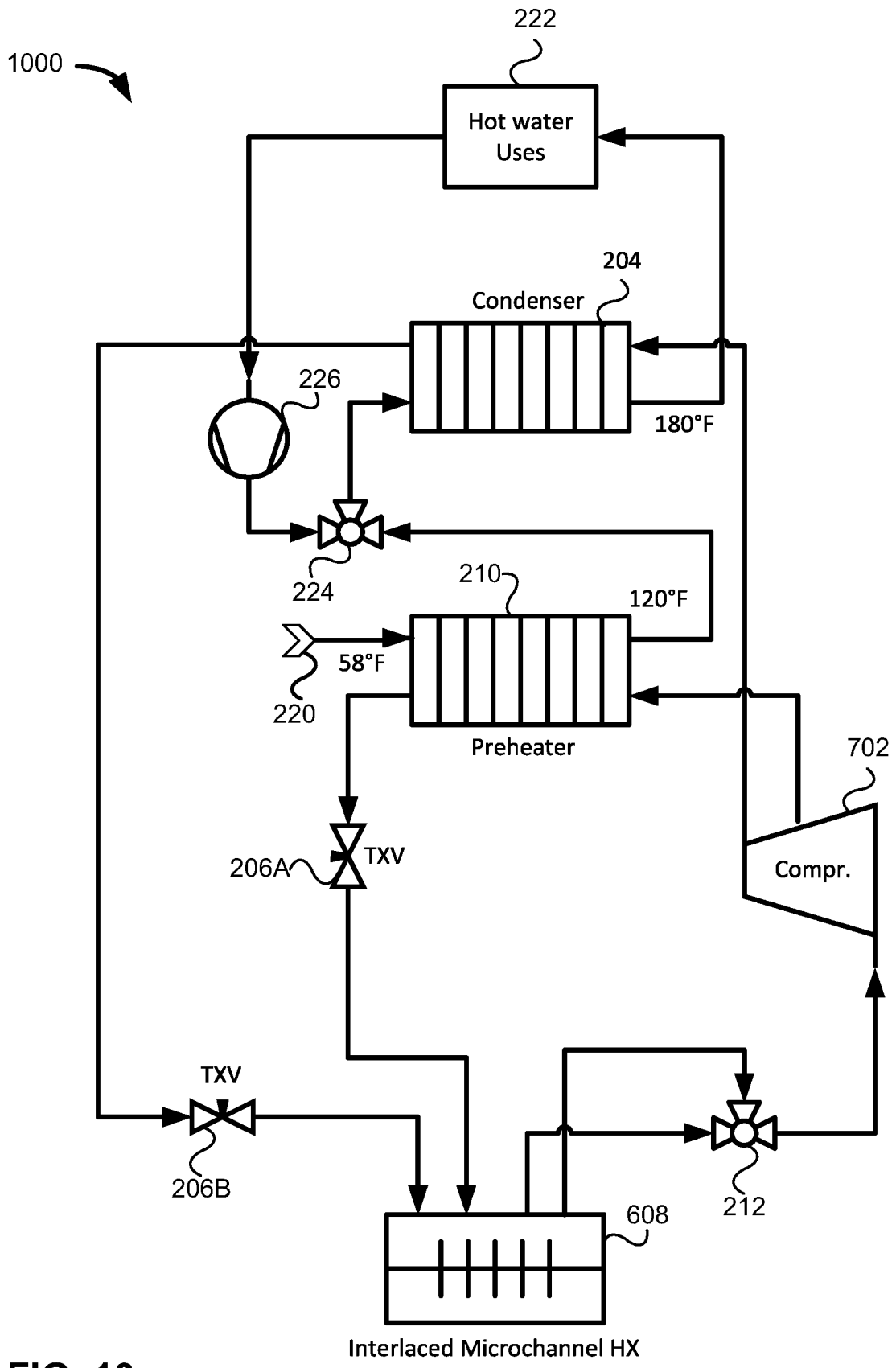
FIG. 10 illustrates a schematic diagram of an example heat pump water heater system having an interlaced microchannel heat exchanger and a single compressor with two outlets, in accordance with the disclosed technology.

FIGS. 8-10 illustrate example variations of heat pump water heaters having a single compressor 702. As will be described in greater detail herein, each variation illustrated in FIGS. 8-10 and described herein can help to increase the efficiency of the HPWH 700. Furthermore, each of the variations illustrated and described herein can be combined to alter the performance of the HPWH 700 depending on the particular application. As a non-limiting example, the configuration of FIG. 8 can be combined with the configurations of FIGS. 9 and 10 depending on the application. Thus, one of skill in the art will appreciate that each of the configurations described in relation to FIGS. 7-10 are not exclusive and can be combined as would be suitable for a particular application. Furthermore, unless stated otherwise, the components described in relation to FIGS. 2 and 7 can be the same or similar components to those described in relation to FIGS. 8-10.

FIG. 8 illustrates a HPWH 800 having a single compressor 702 and a subcooler 404. The HPWH 800 can be configured to operate with the single compressor 702 outputting refrigerant at a first pressure and a second pressure as described in relation to FIGS. 7A and 7B. Furthermore, the HPWH 800 can be configured to heat water and cool refrigerant via the subcooler 404 as described in relation to FIG. 4. In other words, the HPWH 800 can combine the benefits of having a single compressor 702 with the benefits of having a subcooler 404 as described herein.

FIG. 9 illustrates a HPWH 900 having a single compressor 702 and a first and second evaporator 508A, 508B. The HPWH 800 can be configured to operate with the single compressor 702 outputting refrigerant at a first pressure and a second pressure as described in relation to FIGS. 7A and 7B. Furthermore, the HPWH 900 can be configured to heat refrigerant via the first and second evaporators 508A, 508B as described in relation to FIG. 5. In other words, the HPWH 900 can combine the benefits of having a single compressor 702 with the benefits of having the first and second evaporators 508A, 508B as described herein.

FIG. 10 illustrates a HPWH 1000 having a single compressor 702 and an interlaced microchannel heat exchanger 608. The HPWH 1000 can be configured to operate with the single compressor 702 outputting refrigerant at a first pressure and a second pressure as described in relation to FIGS. 7A and 7B. Furthermore, the HPWH 1000 can be configured to heat refrigerant via the interlaced microchannel heat exchanger 608 as described in relation to FIG. 6. In other words, the HPWH 1000 can combine the benefits of having a single compressor 702 with the benefits of having an interlaced microchannel heat exchanger 608 as described herein. Because the HPWH 1000 includes the single compressor 702, however, the HPWH 1000 would require a compressor having two fluidly-separated compression chambers for the HPWH 1000 to include at least two different types of refrigerants. Otherwise, as will be appreciated by one of skill in the art, the HPWH 1000 would have a single refrigerant, the flow of which can be controlled with a refrigerant control valve 212 as illustrated in FIG. 10.

Figure 11:
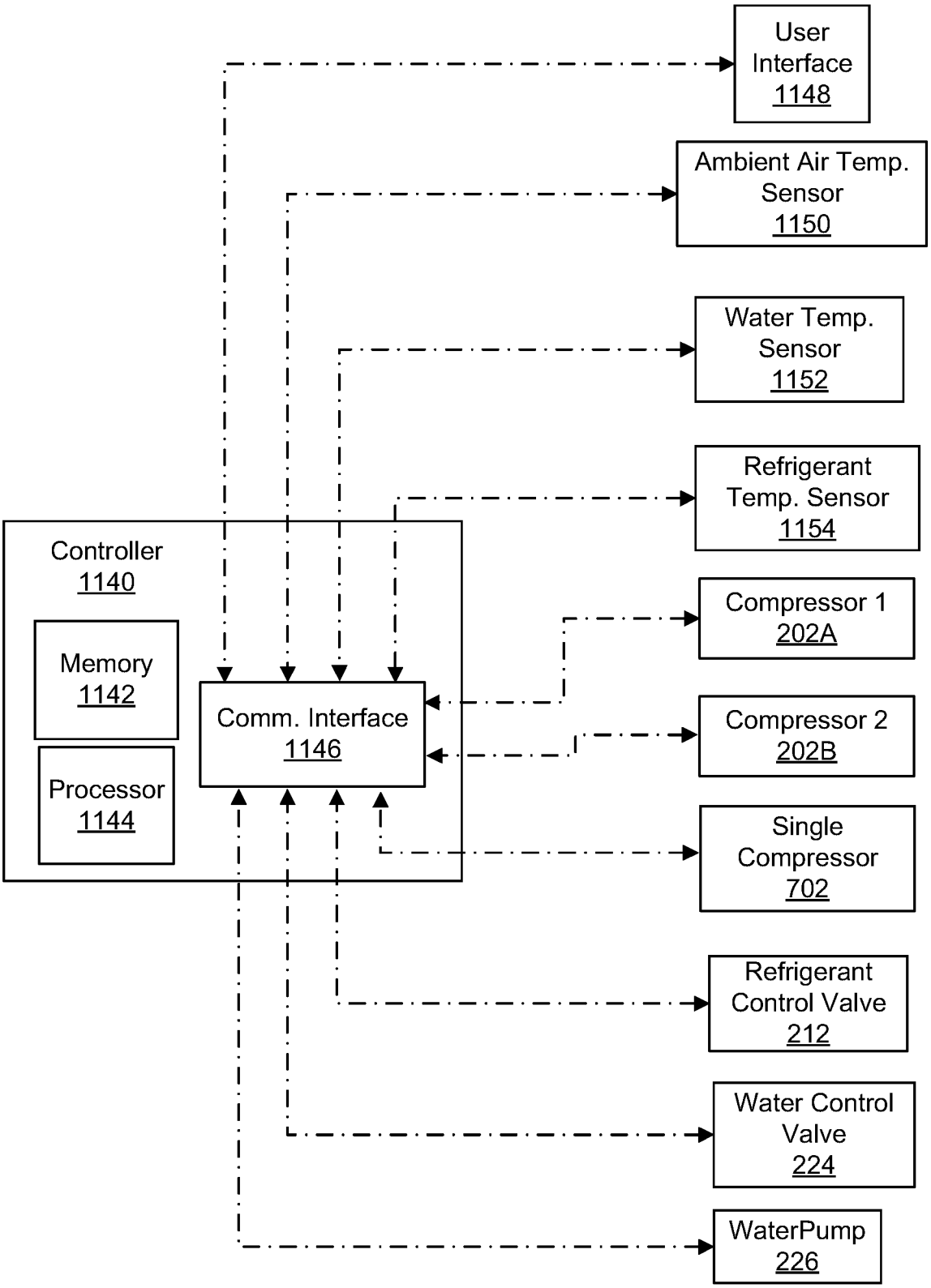
FIG. 11 illustrates a schematic diagram of an example controller and various components of the heat pump water heater system, in accordance with the disclosed technology.

FIG. 11 illustrates a schematic diagram of a controller 1140 and various components of the HPWH systems described herein (i.e., HPWHs 200-1000), in accordance with the disclosed technology. As will be appreciated, the controller 1140 can be configured to control any of HPWHs (i.e., HPWHs 200-1000) described herein. Thus, unless otherwise stated, when describing a HPWH in relation to FIG. 11, it will be understood that the HPWH can be any of HPWHs 200-1000 previously described.

As illustrated in FIG. 11, the disclosed technology can include a controller 1140 that can be configured to receive data and determine actions based on the received data. For example, the controller 1140 can be configured to monitor the temperature of ambient air via an ambient air temperature sensor 1150 and output control signals to the various components described herein to heat the water. As another illustrative example, the controller 1140 can be configured to monitor the temperature of the water (e.g., water entering the HPWHs 200-1000) via a water temperature sensor 1152 and output control signals to the various components described herein to heat the water. As yet another illustrative example, the controller 1140 can be configured to monitor the temperature of the refrigerant in the HPWH via a refrigerant temperature sensor 1154 and output control signals to the various components described herein to heat the water. The controller 1140 can receive data from, or output data to, the user interface 1148, the ambient air temperature sensor 1150, the water temperature sensor 1152, the refrigerant temperature sensor 1154, the first compressor 202A, the second compressor 202B, the single compressor 702, the refrigerant control valve 212, the water control valve 224, and/or the water pump 226.

The ambient air temperature sensor 1150 can be configured to detect a temperature of the ambient air proximate the HPWH. The water temperature sensor 1152 can be configured to detect a temperature of the water supplied to the HPWH, a temperature of the water in the HPWH, and/or a temperature of the water supplied by the HPWH. The refrigerant temperature sensor 1154 can be configured to detect a temperature of the refrigerant of the HPWH. Each of the temperature sensors can be any type of temperature sensor including a thermocouple, a resistance temperature detector, a thermistor, a semiconductor based integrated circuit, or any other suitable type of temperature sensor for the particular application.

The controller 1140 can have a memory 1142, a processor 1144, and a communication interface 1146. The controller 1140 can be a computing device configured to receive data, determine actions based on the received data, and output a control signal instructing one or more components of the HPWHs 200-1000 to perform one or more actions. One of skill in the art will appreciate that the controller 1140 can be installed in any location, provided the controller 1140 is in communication with at least some of the components of the system. Furthermore, the controller 1140 can be configured to send and receive wireless or wired signals and the signals can be analog or digital signals. The wireless signals can include Bluetooth™, BLE, WiFi™, ZigBee™, infrared, microwave radio, or any other type of wireless communication as may be suitable for the particular application. The hard-wired signal can include any directly wired connection between the controller and the other components described herein. Alternatively, the components can be powered directly from a power source and receive control instructions from the controller 1140 via a digital connection. The digital connection can include a connection such as an Ethernet or a serial connection and can utilize any suitable communication protocol for the application such as Modbus, fieldbus, PROFIBUS, SafetyBus p, Ethernet/IP, or any other suitable communication protocol for the application. Furthermore, the controller 1140 can utilize a combination of wireless, hard-wired, and analog or digital communication signals to communicate with and control the various components. One of skill in the art will appreciate that the above configurations are given merely as non-limiting examples and the actual configuration can vary depending on the particular application.

The controller 1140 can include a memory 1142 that can store a program and/or instructions associated with the functions and methods described herein and can include one or more processors 1144 configured to execute the program and/or instructions. The memory 1142 can include one or more suitable types of memory (e.g., volatile or non-volatile memory, random access memory (RAM), read only memory (ROM), programmable read-only memory (PROM), erasable programmable read-only memory (EPROM), electrically erasable programmable read-only memory (EEPROM), magnetic disks, optical disks, floppy disks, hard disks, removable cartridges, flash memory, a redundant array of independent disks (RAID), and the like) for storing files including the operating system, application programs (including, for example, a web browser application, a widget or gadget engine, and or other applications, as necessary), executable instructions and data. One, some, or all of the processing techniques or methods described herein can be implemented as a combination of executable instructions and data within the memory.

The controller 1140 can also have a communication interface 1146 for sending and receiving communication signals between the various components. Communication interface 1146 can include hardware, firmware, and/or software that allows the processor(s) 1144 to communicate with the other components via wired or wireless networks or connections, whether local or wide area, private or public, as known in the art. Communication interface 1146 can also provide access to a cellular network, the Internet, a local area network, or another wide-area network as suitable for the particular application.

Additionally, the controller 1140 can have or be in communication with a user interface 1148 for displaying system information and receiving inputs from a user. The user interface 1148 can be installed locally or be a remotely controlled device such as a mobile device. The user, for example, can view system data on the user interface 1148 and input data or commands to the controller 1140 via the user interface 1148. For example, the user can view temperature threshold settings on the user interface 1148 and provide inputs to the controller 1140 via the user interface 1148 to change a temperature threshold setting. The temperature threshold settings can be, for example, an ambient air temperature threshold, a water temperature threshold, and/or a refrigerant temperature threshold.

Figure 12:
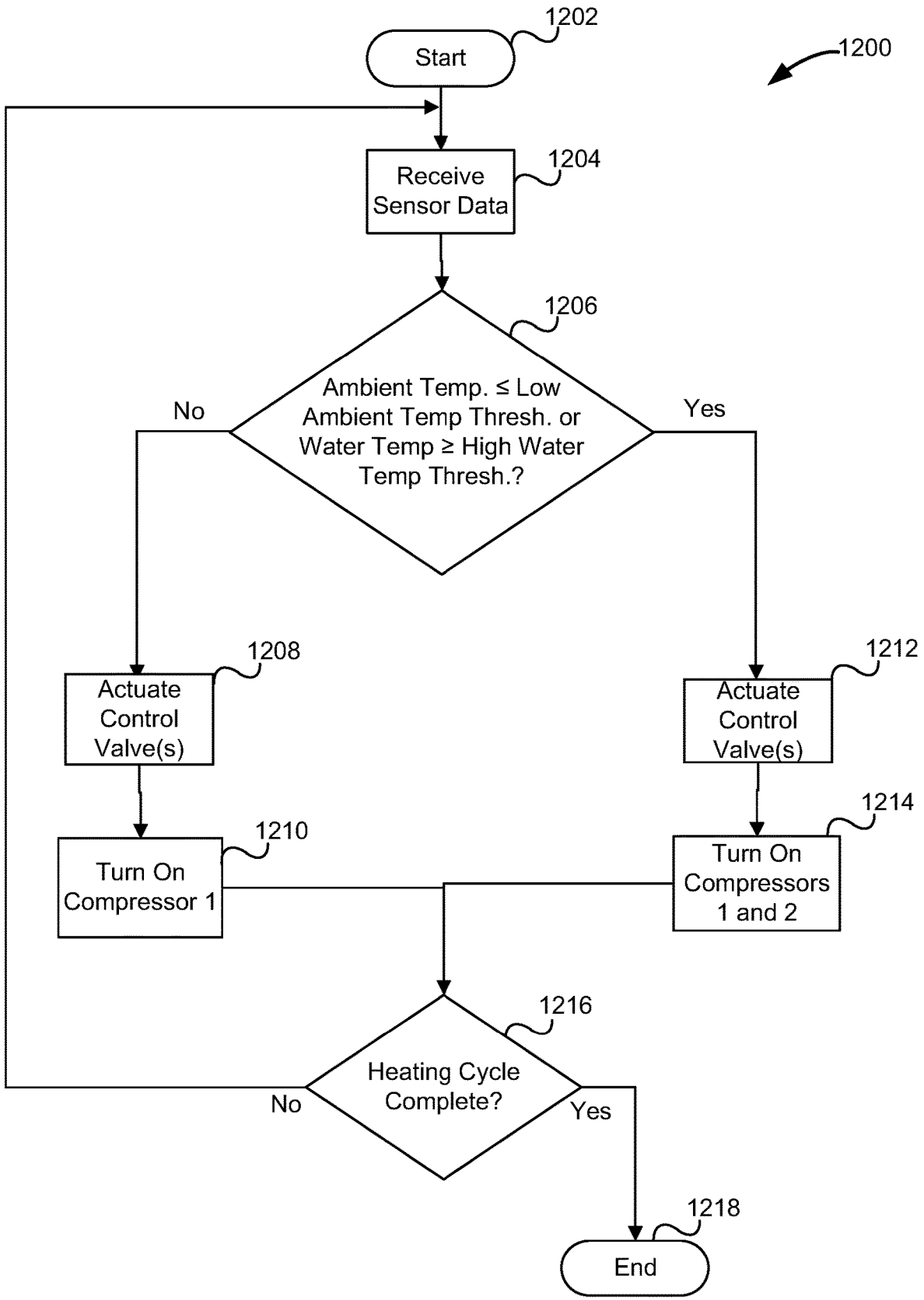
FIG. 12 illustrates a flow chart of an example method of operating a heat pump water heater system, in accordance with the disclosed technology.

FIG. 12 illustrates a flow chart of a method 1200 of operating the heat pump water heater system of FIGS. 2-6 (i.e., HPWHs 200-600), in accordance with the disclosed technology. The method 1200 can include starting 1202 a logic sequence by receiving a start signal or by initiating the method 1200 (e.g., as power is received to the controller 1140). The method 1200 can include receiving 1204 sensor data from one or more sensors in the heat pump system (e.g., ambient temperature data from the ambient air temperature sensor 1150, water temperature data from the water temperature sensor 1152, refrigerant temperature data from the refrigerant temperature sensor 1154, humidity data from a humidity sensor, flow data from a flow sensor, or any other data from a connected sensor).

The method 1200 can include determining 1206 whether the ambient temperature is less than or equal to a low ambient temperature threshold or whether the water temperature is greater than or equal to a high water temperature threshold. The low ambient temperature threshold can be, for example, a temperature of the ambient air wherein the HPWH begins to be unable to sufficiently heat the water to a water temperature threshold. For example, as will be appreciated by one of skill in the art, as the temperature of the ambient air begins to decrease to a low temperature (e.g., below a freezing temperature (32° F.)), the HPWH will begin to be unable to sufficiently heat the water for the various hot water uses 222. In this scenario, the load on the HPWH will be high. Similarly, as the temperature of the water increases above a high water temperature threshold, the HPWH is less able to transfer heat from the refrigerant to the water because the temperature differential between the refrigerant and the water decreases. As the temperature of the water increases, the load on the HPWH will also begin to increase.

If the ambient temperature is greater than the low ambient temperature threshold or the water temperature is less than the high water temperature threshold, the method 1200 can include outputting 1208 a control signal to actuate refrigerant control valves (e.g., refrigerant control valves 212A, 212B) and cause refrigerant to pass through the preheater 210 and not through the condenser 204. The method 1200 can further include outputting 1210 a control signal to turn on the first compressor 202A to cause the refrigerant to circulate through the preheater 210 and the evaporator 208 to heat the water. The method can include determining 1216 whether the heating cycle is complete. The heating cycle can be complete, for example, when the water temperature has reached a threshold temperature (e.g., a target temperature), after the water has been heated for a predetermined length of time, when a demand for heated water is no longer present, when a temperature of a building is sufficiently heated by the space heating, and/or other conditions which would indicate that the water no longer needs to be heated. If the heating cycle is determined 1216 to be complete, the method 1200 can end 1218 by shutting down the HPWH, placing the HPWH on standby mode, turning off the first compressor 202A, or other similar actions which would cause the HPWH to no longer heat the water. If the heating cycle is not complete, the method 1200 can include once again receiving 1204 the sensor data and continuing the method 1200.

If the ambient air temperature is less than or equal to the low ambient temperature threshold or if the water temperature is greater than or equal to the high water temperature threshold, the method 1200 can include outputting 1212 a control signal to actuate refrigerant control valves (e.g., refrigerant control valves 212A, 212B) and cause refrigerant to pass through the condenser 204 and the preheater 210. The method 1200 can further include outputting 1214 a control signal to turn on the first compressor 202A and the second compressor 202B to cause refrigerant to circulate through the condenser 204 and the evaporator preheater 210.

The method 1200 can further include determining 1216 whether the heating cycle is complete. If the heating cycle is determined 1216 to be complete, the method 1200 can end 1218 by shutting down the HPWH, placing the HPWH on standby mode, turning off the compressor 202, or other similar actions which would cause the HPWH to no longer heat the water. If the heating cycle is not complete, the method 1200 can include once again receiving 1204 the sensor data and continuing the method 1200.

Figure 13:
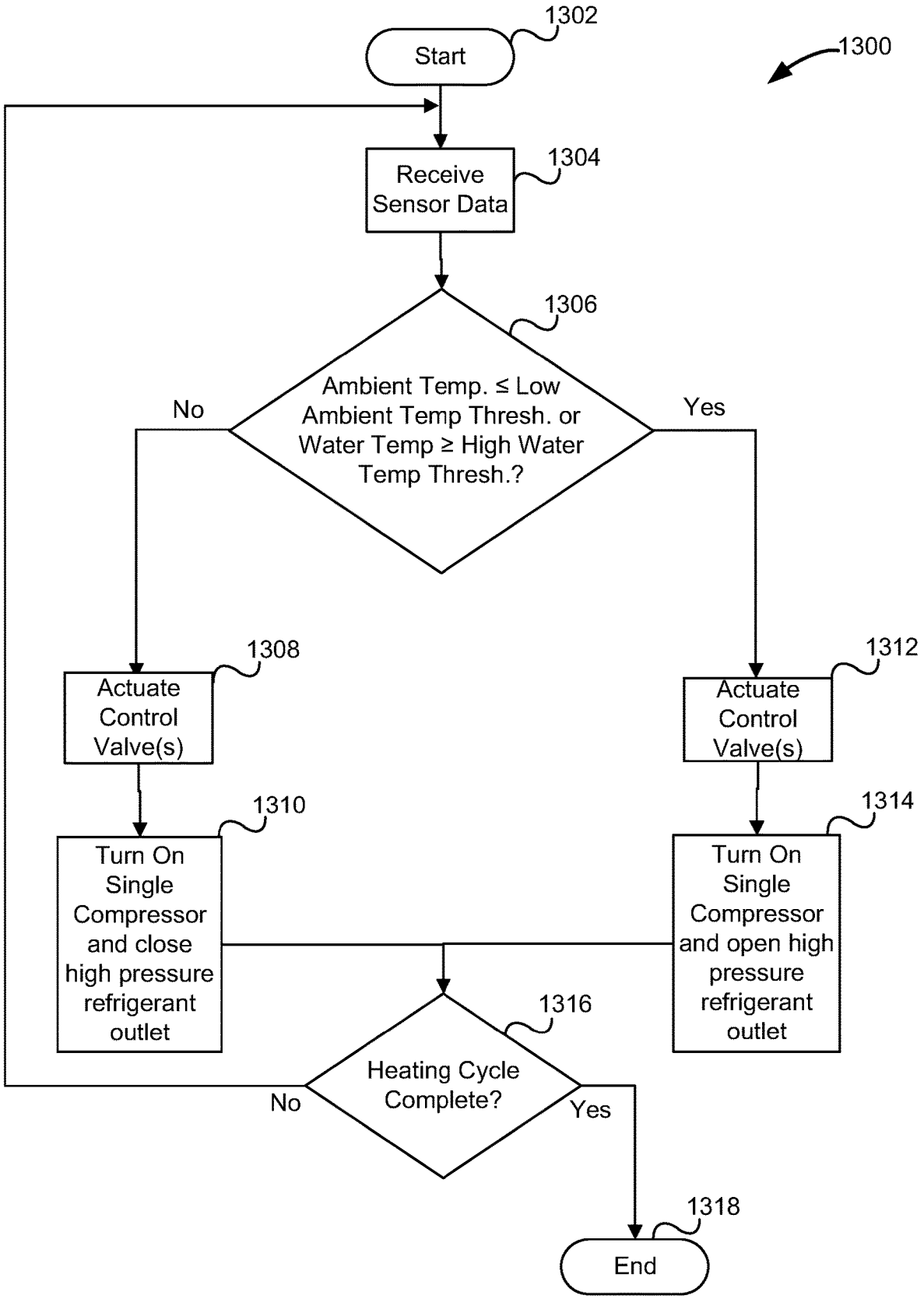
FIG. 13 illustrates a flow chart of an example method of operating a heat pump water heater system, in accordance with the disclosed technology.

FIG. 13 illustrates a flow chart of a method 1300 of operating the heat pump water heater system of FIGS. 7-10 (i.e., HPWHs 700-1000), in accordance with the disclosed technology. The method 1300 can include starting 1302 a logic sequence by receiving a start signal or by initiating the method 1300 (e.g., as power is received to the controller 1140). The method 1300 can include receiving 1304 sensor data from one or more sensors in the heat pump system (e.g., ambient temperature data from the ambient air temperature sensor 1150, water temperature data from the water temperature sensor 1152, refrigerant temperature data from the refrigerant temperature sensor 1154, humidity data from a humidity sensor, flow data from a flow sensor, or any other data from a connected sensor).

The method 1300 can include determining 1306 whether the ambient temperature is less than or equal to a low ambient temperature threshold or whether the water temperature is greater than or equal to a high water temperature threshold. The low ambient temperature threshold can be, for example, a temperature of the ambient air wherein the HPWH begins to be unable to sufficiently heat the water to a water temperature threshold. For example, as will be appreciated by one of skill in the art, as the temperature of the ambient air begins to decrease to a low temperature (e.g., below a freezing temperature (32° F.)), the HPWH will begin to be unable to sufficiently heat the water for the various hot water uses 222. In this scenario, the load on the HPWH will be high. Similarly, as the temperature of the water increases above a high water temperature threshold, the HPWH is less able to transfer heat from the refrigerant to the water because the temperature differential between the refrigerant and the water decreases. As the temperature of the water increases, the load on the HPWH will also begin to increase.

If the ambient temperature is greater than the low ambient temperature threshold or the water temperature is less than the high water temperature threshold, the method 1300 can include outputting 1308 a control signal to actuate refrigerant control valves (e.g., refrigerant control valve 212) and cause refrigerant to pass through the preheater 210 and not through the condenser 204. The method 1300 can further include outputting 1310 a control signal to turn on the single compressor 702 and close the high pressure refrigerant outlet (the second outlet) to cause the refrigerant to circulate through the preheater 210 and not through the condenser 204 to heat the water. The method can include determining 1316 whether the heating cycle is complete. The heating cycle can be complete, for example, when the water temperature has reached a threshold temperature (e.g., a target temperature), after the water has been heated for a predetermined length of time, when a demand for heated water is no longer present, when a temperature of a building is sufficiently heated by the space heating, and/or other conditions which would indicate that the water no longer needs to be heated. If the heating cycle is determined 1316 to be complete, the method 1300 can end 1318 by shutting down the HPWH, placing the HPWH on standby mode, turning off the single compressor 702, or other similar actions which would cause the HPWH to no longer heat the water. If the heating cycle is not complete, the method 1300 can include once again receiving 1304 the sensor data and continuing the method 1300.

If the ambient air temperature is less than or equal to the low ambient temperature threshold or if the water temperature is greater than or equal to the high water temperature threshold, the method 1300 can include outputting 1312 a control signal to actuate refrigerant control valves (e.g., refrigerant control valve 212) and cause refrigerant to pass through both the condenser 204 and the preheater 210. The method 1300 can further include outputting 1314 a control signal to turn on the single compressor 702 and open the high pressure refrigerant outlet (the second outlet) to cause refrigerant to circulate through both the condenser 204 and the preheater 210.

The method 1300 can further include determining 1316 whether the heating cycle is complete. If the heating cycle is determined 1316 to be complete, the method 1300 can end 1318 by shutting down the HPWH, placing the HPWH on standby mode, turning off the compressor 202, or other similar actions which would cause the HPWH to no longer heat the water. If the heating cycle is not complete, the method 1300 can include once again receiving 1304 the sensor data and continuing the method 1300.

As will be appreciated, the methods 1200 and 1300 just described can be varied in accordance with the various elements and implementations described herein. That is, methods in accordance with the disclosed technology can include all or some of the steps or components described above and/or can include additional steps or components not expressly disclosed above. Further, methods in accordance with the disclosed technology can include some, but not all, of a particular step described above. Further still, various methods described herein can be combined in full or in part. That is, methods in accordance with the disclosed technology can include at least some elements or steps of a first method and at least some elements or steps of a second method.

The disclosed technology, although described in the context of being a heat pump water heating system, can be applicable to water cooling systems or other fluid cooling systems. For example, the HPWH 200 can be configured to circulate the refrigerant in a reverse direction such that the condenser 204 acts as an evaporator and the evaporator 208 acts as a condenser. In this way, the HPWH 200 can remove heat from water to sufficiently cool the water for end uses. This can be useful in applications where source water may be at temperature that is greater than the temperature of water necessary for the end use.

As mentioned previously, although described herein as being a heat pump water heating system, the disclosed technology can also be applicable to air heating and cooling systems (i.e., a heating ventilation and air conditioning (HVAC) system). For example, the HVAC system can be a system including all of the same components as those discussed in relations to the HPWH 200 herein. Furthermore, when in a heating mode, the HVAC system can operate similar to the HPWH system in that the first compressor 202A, the second compressor 202B and the control valves 212A, 212B can circulate the refrigerant through the condenser 204, the evaporator 208, the preheater 210 and the first expansion valve 206A, and the second expansion valve 206B to heat the air to a sufficient temperature in accordance with the methods and systems described herein.

When in a heating mode, the HVAC system can be configured to circulate the refrigerant in a reverse direction such that the condenser 204 acts as an evaporator and the evaporator 208 acts as a condenser. In this way, the HVAC system can remove heat from air circulated through a ventilated space to provide cooling to the ventilated space. As will be appreciated, the disclosed technology can be particularly helpful in areas having high ambient temperatures because the disclosed technology can be configured to cool air sufficiently even when ambient temperatures are high. Furthermore, as will be appreciated, rather than activating the first compressor 202A and/or the second compressor 202B based on the ambient temperature being below a low ambient temperature, the HVAC system can be configured to activate the first compressor 202A and/or the second compressor 202B based on the ambient temperature being greater than a high ambient temperature. Thus, one of skill in the art will understand that the disclosed technology can be applicable to HVAC systems while remaining within the scope of this disclosure.

While the present disclosure has been described in connection with a plurality of exemplary aspects, as illustrated in the various figures and discussed above, it is understood that other similar aspects can be used, or modifications and additions can be made to the described subject matter for performing the same function of the present disclosure without deviating therefrom. In this disclosure, methods and compositions were described according to aspects of the presently disclosed subject matter. But other equivalent methods or compositions to these described aspects are also contemplated by the teachings herein. Therefore, the present disclosure should not be limited to any single aspect, but rather construed in breadth and scope in accordance with the appended claims.

What is claimed is:

1. A heat pump water heater system comprising:

an evaporator configured to facilitate heat exchange between ambient air and a refrigerant;

a first compressor configured to compress the refrigerant to a first pressure;

a second compressor configured to compress the refrigerant to a second pressure, the second pressure being greater than the first pressure, wherein the first compressor and the second compressor are coupled to the evaporator in parallel;

a preheater disposed downstream of the first compressor configured to receive the refrigerant at the first pressure from the first compressor and facilitate heat exchange between the refrigerant at the first pressure and water; and a condenser disposed downstream of both the second compressor and the preheater, the condenser configured to receive the refrigerant at the second pressure from the second compressor and facilitate heat exchange between the refrigerant at the second pressure and the water, wherein the heat pump water heater system is configured to pass the water through the preheater before passing the water through the condenser.

2. The heat pump water heater system of claim 1 further comprising:

a control valve configured to control a flow of the refrigerant to the second compressor;

an ambient air temperature sensor configured to detect a temperature of ambient air; and a controller configured to:

receive ambient air temperature data from the ambient air temperature sensor;

determine, based at least in part on the ambient air temperature data, whether the temperature of the ambient air is less than or equal to a low ambient temperature threshold; and in response to determining that the temperature of the ambient air is less than or equal to the low ambient temperature threshold:

output a first control signal to open the control valve to permit the refrigerant to flow to the second compressor; and output a second control signal to cause the second compressor to compress the refrigerant to the second pressure.

3. The heat pump water heater system of claim 2 wherein the second compressor is configured to receive the refrigerant at the first pressure from the first compressor and the control valve is positioned in a fluid flow path between the first compressor and the second compressor.

4. The heat pump water heater system of claim 2 wherein the evaporator is a first evaporator and the heat pump water heater system further comprises a second evaporator, the first evaporator being configured to receive the refrigerant from the condenser and the second evaporator being configured to receive the refrigerant from the preheater, wherein the control valve is positioned in a fluid flow path downstream of the first evaporator and the second evaporator and upstream of the first compressor and the second compressor.

5. The heat pump water heater system of claim 2 further comprising a subcooler, wherein the subcooler is configured to receive the refrigerant from the condenser and facilitate heat transfer between the water and the refrigerant received from the condenser.

6. The heat pump water heater system of claim 5 further comprising a water flow control valve, the water flow control valve being configured to control a flow of water to the preheater, the subcooler, and the condenser.

7. The heat pump water heater system of claim 6, the controller being further configured to, in response to determining that the temperature of the ambient air is less than or equal to the low ambient temperature threshold, output a control signal to the water flow control valve to cause the water to flow through the subcooler.

8. The heat pump water heater system of claim 2 wherein the evaporator comprises an interlaced microchannel heat exchanger configured to facilitate heat transfer between the refrigerant at the first pressure and the ambient air, and the refrigerant at the second pressure and the ambient air.

9. The heat pump water heater system of claim 8 wherein the interlaced microchannel heat exchanger is configured to fluidly separate the refrigerant at the first pressure, the refrigerant at the second pressure, and the ambient air.

10. The heat pump water heater system of claim 9 wherein the refrigerant at the first pressure and the refrigerant at the second pressure comprise two different types of refrigerant.

11. The heat pump water heater system of claim 9, wherein the refrigerant at the first pressure comprises R1234yf refrigerant and the refrigerant at the second pressure comprises $CO_2$.

12. The heat pump water heater system of claim 1, wherein the condenser is further disposed downstream of the first compressor, and wherein fluid flows from the condenser to the evaporator.

13. A heat pump water heater system comprising:

an evaporator configured to facilitate heat exchange between ambient air and a refrigerant;

a compressor comprising a first outlet and a second outlet, the compressor being configured to (i) compress the refrigerant to a first pressure and output the refrigerant at the first pressure from the first outlet and (ii) compress the refrigerant to a second pressure and output the refrigerant at the second pressure from the second outlet, the second pressure being greater than the first pressure;

a preheater disposed downstream of the compressor configured to receive the refrigerant at the first pressure from the first outlet and facilitate heat exchange between the refrigerant at the first pressure and water; and a condenser disposed downstream of both the compressor and the preheater, the condenser configured to receive the refrigerant at the second pressure from the second outlet and facilitate heat exchange between the refrigerant at the second pressure and the water, wherein the heat pump water heater system is configured to pass the water through the preheater before passing the water through the condenser.

14. The heat pump water heater system of claim 13, further comprising:

an ambient air temperature sensor configured to detect a temperature of ambient air; and a controller configured to:

receive ambient air temperature data from the ambient air temperature sensor;

determine, based at least in part on the ambient air temperature data, whether the temperature of the ambient air is less than or equal to a low ambient temperature threshold; and in response to determining that the temperature of the ambient air is less than or equal to the low ambient temperature threshold, output a control signal to cause the compressor to open the second outlet to cause the refrigerant at the second pressure to pass through the condenser.

15. The heat pump water heater system of claim 14, wherein the evaporator comprises a first evaporator and the heat pump water heater system further comprises a second evaporator, the first evaporator being configured to receive the refrigerant from the condenser and the second evaporator being configured to receive the refrigerant from the preheater.

16. The heat pump water heater system of claim 14, further comprising a subcooler, wherein the subcooler is configured to receive the refrigerant from the condenser and facilitate heat transfer between the water and the refrigerant received from the condenser.

17. The heat pump water heater system of claim 16, further comprising a water flow control valve, the water flow control valve being configured to control a flow of water to the preheater, the subcooler, and the condenser.

18. The heat pump water heater system of claim 17, the controller being further configured to, in response to determining that the temperature of the ambient air is less than or equal to the low ambient temperature threshold, output a control signal to the water flow control valve to cause the water to flow through the subcooler.

19. The heat pump water heater system of claim 14, wherein the evaporator comprises an interlaced microchannel heat exchanger configured to facilitate heat transfer between the refrigerant at the first pressure and the ambient air, and the refrigerant at the second pressure and the ambient air.

20. The heat pump water heater system of claim 19, wherein the interlaced microchannel heat exchanger is configured to fluidly separate the refrigerant at the first pressure, the refrigerant at the second pressure, and the ambient air.

* * * * *